US007824222B2

(12) United States Patent
Miyoshi et al.

(10) Patent No.: US 7,824,222 B2
(45) Date of Patent: Nov. 2, 2010

(54) CONNECTOR

(75) Inventors: Toshiharu Miyoshi, Osaka (JP); Kenji Miki, Osaka (JP)

(73) Assignee: Hosiden Corporation, Yao-shi, Osaka (JP)

( * ) Notice: Subject to any disclaimer, the term of this patent is extended or adjusted under 35 U.S.C. 154(b) by 0 days.

(21) Appl. No.: 12/155,964

(22) Filed: Jun. 12, 2008

(65) Prior Publication Data

US 2009/0004916 A1 Jan. 1, 2009

(30) Foreign Application Priority Data

Jun. 29, 2007 (JP) ..... 2007-172303

(51) Int. Cl.
*H01R 9/03* (2006.01)

(52) U.S. Cl. ..... 439/610

(58) Field of Classification Search ..... 439/608, 439/610

See application file for complete search history.

(56) References Cited

U.S. PATENT DOCUMENTS 5,425,657 A * 6/1995 Davis et al. ..... 439/607.52
5,725,395 A * 3/1998 Lee ..... 439/607.48
5,938,476 A * 8/1999 Wu et al. ..... 439/607.57
6,039,606 A * 3/2000 Chiou ..... 439/610
6,210,231 B1 * 4/2001 Lai ..... 439/607.44
6,280,252 B1 * 8/2001 Huang ..... 439/607.48
6,599,151 B2 * 7/2003 Chiran et al. ..... 439/607.48
6,783,397 B2 * 8/2004 Yang Lee ..... 439/607.45

FOREIGN PATENT DOCUMENTS

| | | |
|---|---|---|
| CN | 2 906 973 | 5/2007 |
| EP | 1 801 929 | 6/2007 |
| JP | 2001 517360 | 10/2001 |

* cited by examiner

*Primary Examiner*—Truc T Nguyen
(74) *Attorney, Agent, or Firm*—Bacon & Thomas, PLLC

(57) ABSTRACT

The invention provides a connector in which, in an over-mold process, it is possible to prevent a molten resin from flowing through inevitable gaps (88, 89) of a shell (80) into the inside of the shell, thereby preventing problems such as that movable portions of contacts (20) become immovable, from arising. The connector of the invention has a plug body (10) in which contacts (20) to be connected to a cable (70) are held by an insulative body (40), the body (40) is shielded by a shell (80) formed by a metal plate, and a part of the plug body (10) is over-molded. The body (40) has sealing portions (41, 42) which are fitted into gaps (88, 89) of the shell (80) to close the gaps (88, 89).

6 Claims, 15 Drawing Sheets

1
2
3
24
34
40b
70
85
85c
85d 70
1
3
95
2
86
10
93
81
82
42(89)
32
34
85
84b
84a
94
93b
91
84
93a
85d

A
A
80
81
82
83
83a
83b
84
84a
84b
85
85a
85b
85c
85d
86
87
88
89

CONNECTOR

BACKGROUND OF THE INVENTION

1. Field of the Invention

The present invention relates to a connector.

2. Description of the Prior Art

Conventionally, a USB connector plug is known that comprises a plug body which has contacts to be connected to a cable, and in which the contacts are held by an insulative body having: a plug grip portion that is formed in the rear side in the insertion direction of a plug (connector) with respect to a receptacle (counter connector); and a fitting portion that is projected from the grip portion toward a front side in the insertion direction, and to be inserted into the receptacle, and that is thinner than the grip portion, the grip portion and fitting portion of the body are shielded by a shell formed by a metal plate, and a range from an end portion of the cable to a root portion of the fitting portion via the grip portion of the body of the plug body is over-molded (for example, see Published Japanese Translation of PCT Patent Application No. 2001-517360).

SUMMARY OF THE INVENTION

The shell of the conventional plug is formed by stamping a metal plate, and then bending the stamped metal plate. Formation of sharp edges in the bending process requires advanced techniques, and is not advantageously performed from the viewpoint of cost. In the case where the material is stainless steel or the plate is thin, for example, formation of sharp edges cannot be performed. Therefore, edges are inevitably rounded. Consequently, gaps are formed between adjacent ones of side plates which are formed by raising extension portions of a base of the shell, and, in an over-mold process (insert molding), a molten resin flows through the gaps of the shell into the inside of the shell, thereby causing problems such as that movable portions of the contacts become immovable.

When adjacent side plates of the shell are formed by raising respective extension portions of the base at a bending angle of 90 deg., the gap formed between the adjacent side plates is minimum. Even in the case of the minimum gap, such a molten resin flow is sufficiently produced. When one of adjacent side plates is formed by raising an extension portion of the base at a bending angle of 90 deg. and the other adjacent side plate is formed by raising an extension portion of the base at a bending angle smaller than 90 deg., moreover, the size of the gap formed between the adjacent side plates becomes larger in proportion to the difference of the bending angles.

It is an object of the invention to provide a connector in which, in an over-mold process, it is possible to prevent a molten resin from flowing through gaps of a shell into the inside of the shell, thereby preventing various problems from arising.

The connector of the invention which can attain the object is a connector comprising a plug body which has contacts to be connected to a cable, and in which the contacts are held by an insulative body, the body is shielded by a shell formed by a metal plate, and a part of the plug body is over-molded, wherein the shell has a rectangular base, and plural side plates formed by raising extension portions of the base, and the body has sealing portions which are fitted into gaps formed between the adjacent side plates of the shell to close the gaps.

In the connector of the invention, preferably, the body has: a grip portion of the connector which is formed in a rear side in an insertion direction of the connector with respect to a counter connector; and a fitting portion which is projected from the grip portion toward a front side in the insertion direction, which is to be inserted into the counter connector, and which is thinner than the grip portion, the shell has: a front side plate which covers a front end face of the grip portion that is in the front side in the insertion direction; right and left side plates which extend along right and left side faces adjacent to the front end face of the grip portion; and a tubular portion which is formed by bending an extension portion of the front side plate, and which covers the fitting portion, the sealing portions are fitted into gaps formed between the front side plate and the right and left side plates to close the gaps, and a range from the grip portion of the body of the plug body to a root portion of the fitting portion is over-molded.

In the connector of the invention, preferably, the connector has a latch which, when the fitting portion of the body is inserted into the counter connector, is engaged with the counter connector.

In the connector of the invention, preferably, the shell has a fixing portion which is configured by an extension portion located in the rear side of the base in the insertion direction, and which is to be coupled to the cable connected to the contacts, and a range from an end portion of the cable to the root portion of the fitting portion via the grip portion of the body of the plug body is over-molded.

In the connector of the invention, preferably, the connector further comprises a shell cover which has: another base opposed to the base; and other right and left side plates that are formed by raising extension portions of the other base, and that overlap the right and left side plates, and which is configured by a metal plate cooperating with the shell to cover a whole periphery of the grip portion of the body.

In the connector of the invention, preferably, the shell cover has another fixing portion which is configured by an extension portion located in the rear side of the other base in the insertion direction, and which is to be coupled to the cable connected to the contacts.

Preferably, the connector of the invention is a micro USB plug which is compliant with a micro USB connector standard.

As described above, in the connector of the invention, gaps of the shell that are inevitably formed are closed by the sealing portions of the body, and hence it is possible to provide a connector in which, in an over-mold process, it is possible to prevent a molten resin from flowing through gaps of a shell into the inside of the shell, thereby preventing problems such as that movable portions of the contacts become immovable, from arising.

DETAILED DESCRIPTION OF THE PREFERRED EMBODIMENT

Hereinafter, an embodiment of the invention will be described in detail with reference to the drawings.

Figures 1A, 1B, 1C:
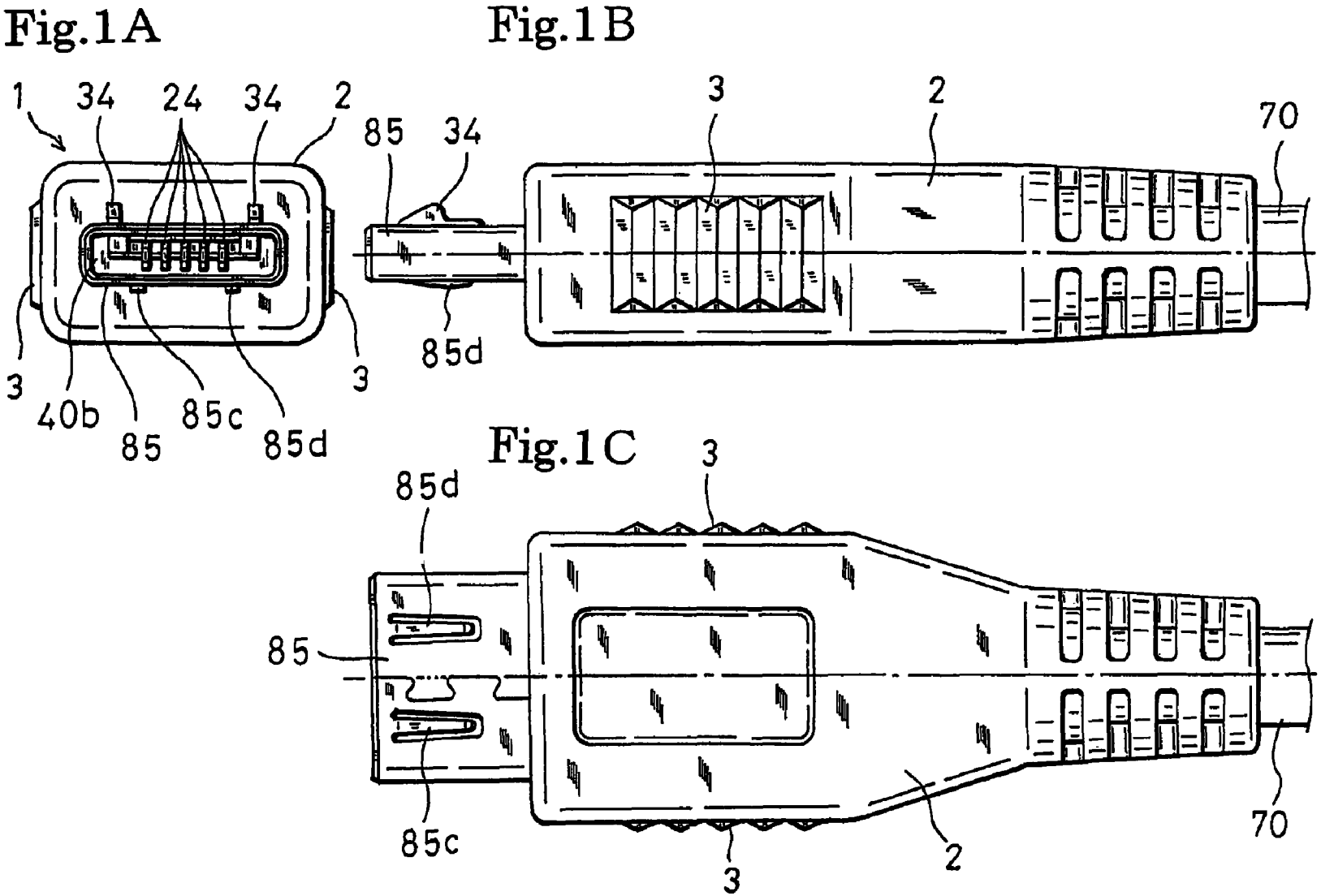
FIG. 1A is a front view of a connector of an embodiment of the invention.
FIG. 1B is a right side view of the connector.
FIG. 1C is a bottom view of the connector.
Figures 2A, 2B:
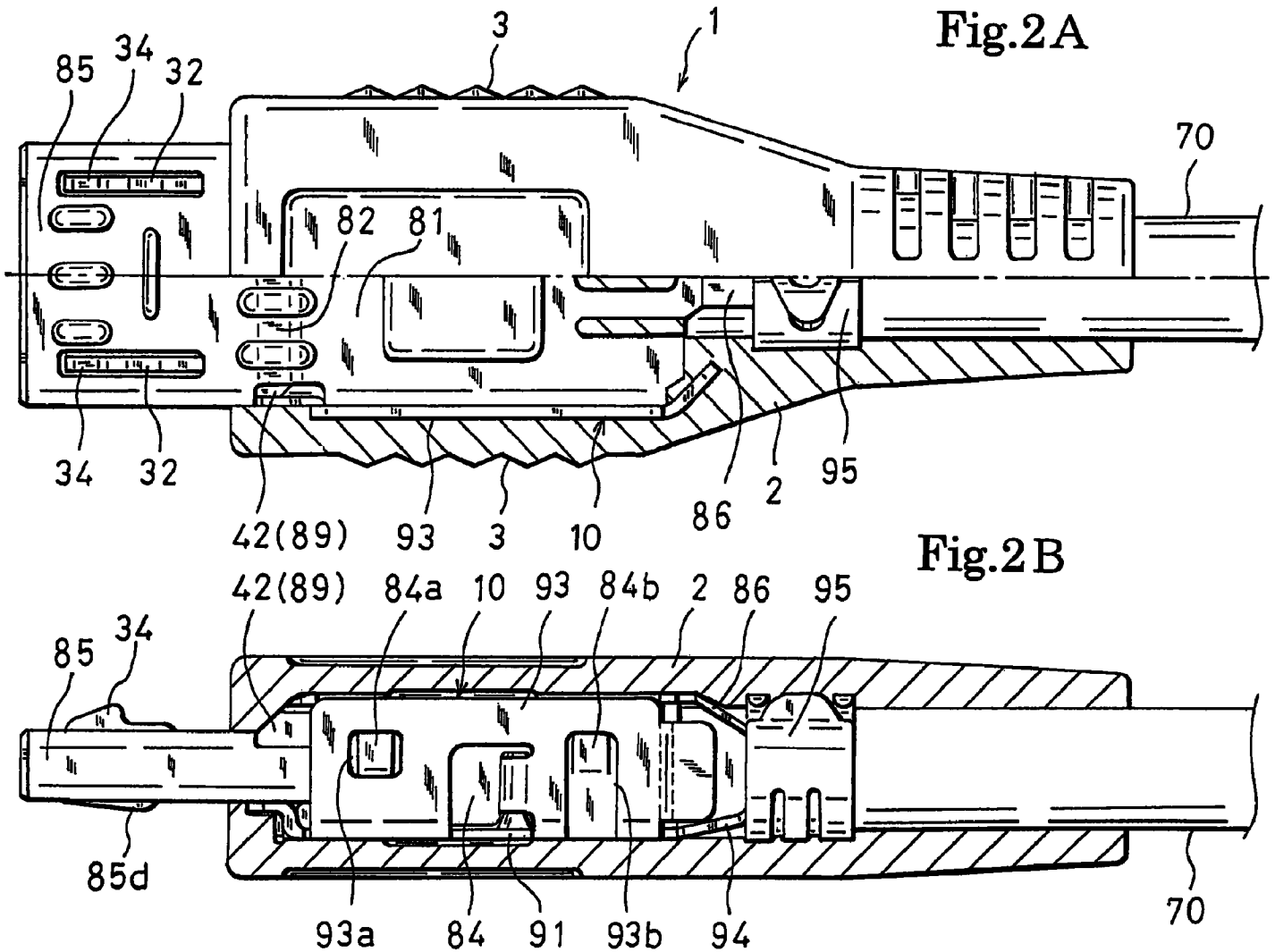
FIG. 2A is a plan view of a state where only an over-mold of the connector is half-sectioned.
FIG. 2B is a right side view of a state where only the over-mold of the connector is full-sectioned.
Figure 3:
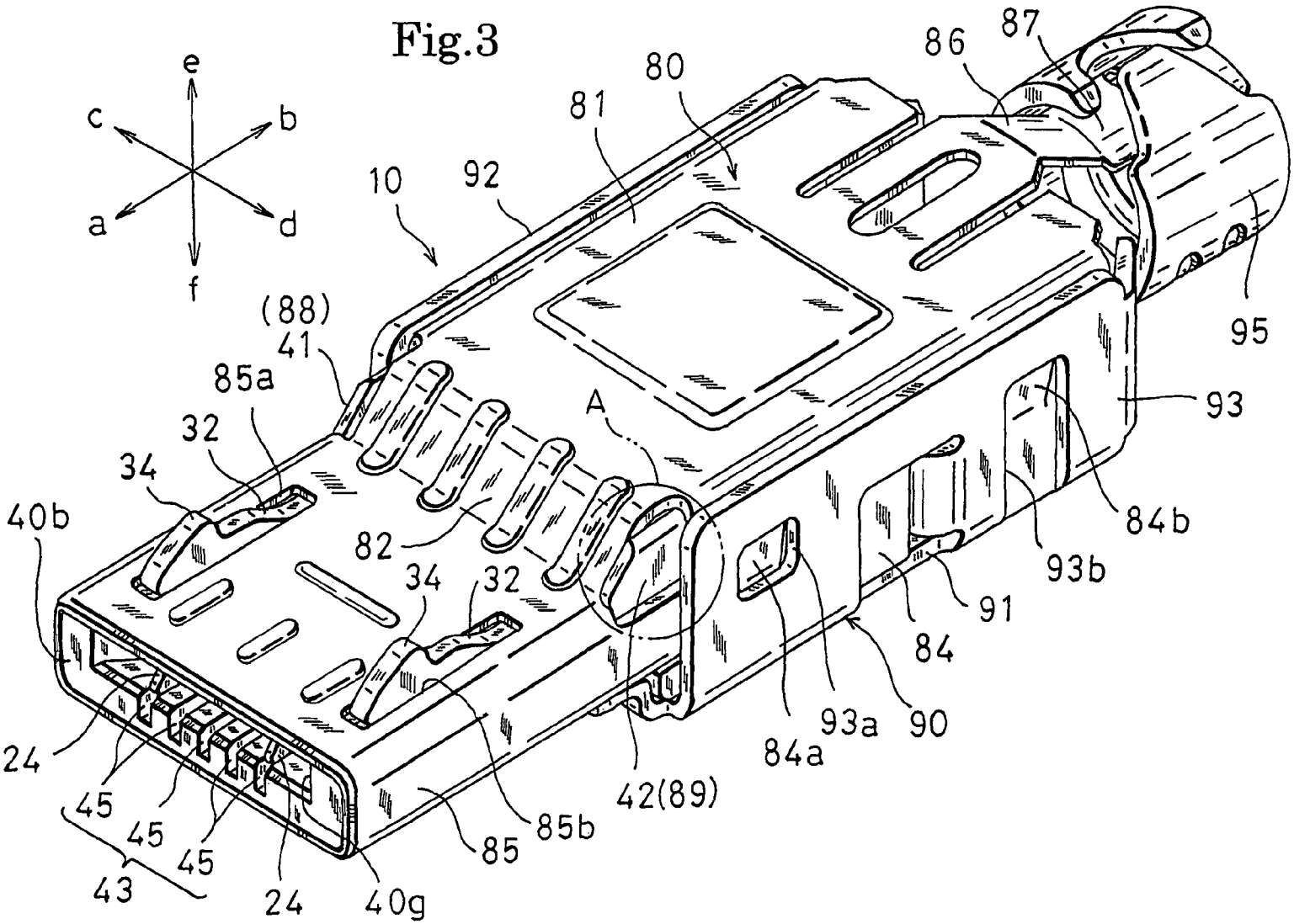
FIG. 3 is a perspective view showing the front, plan, and right side faces of a plug body of the connector (a cable is not shown).

In the following description, unless otherwise specified, it is assumed that the direction of the arrows a-b in FIG. 3 is the anteroposterior direction (the longitudinal direction of a connector) which is the insertion/extraction direction of the connector with respect to a counter connector, that of the arrows c-d is the lateral direction (the width direction of the connector) which is a pitch direction perpendicular to the insertion/extraction direction, and that of the arrows e-f is the vertical direction (the thickness direction of the connector) which is a direction perpendicular to the insertion/extraction direction and the pitch direction.

Figure 5:
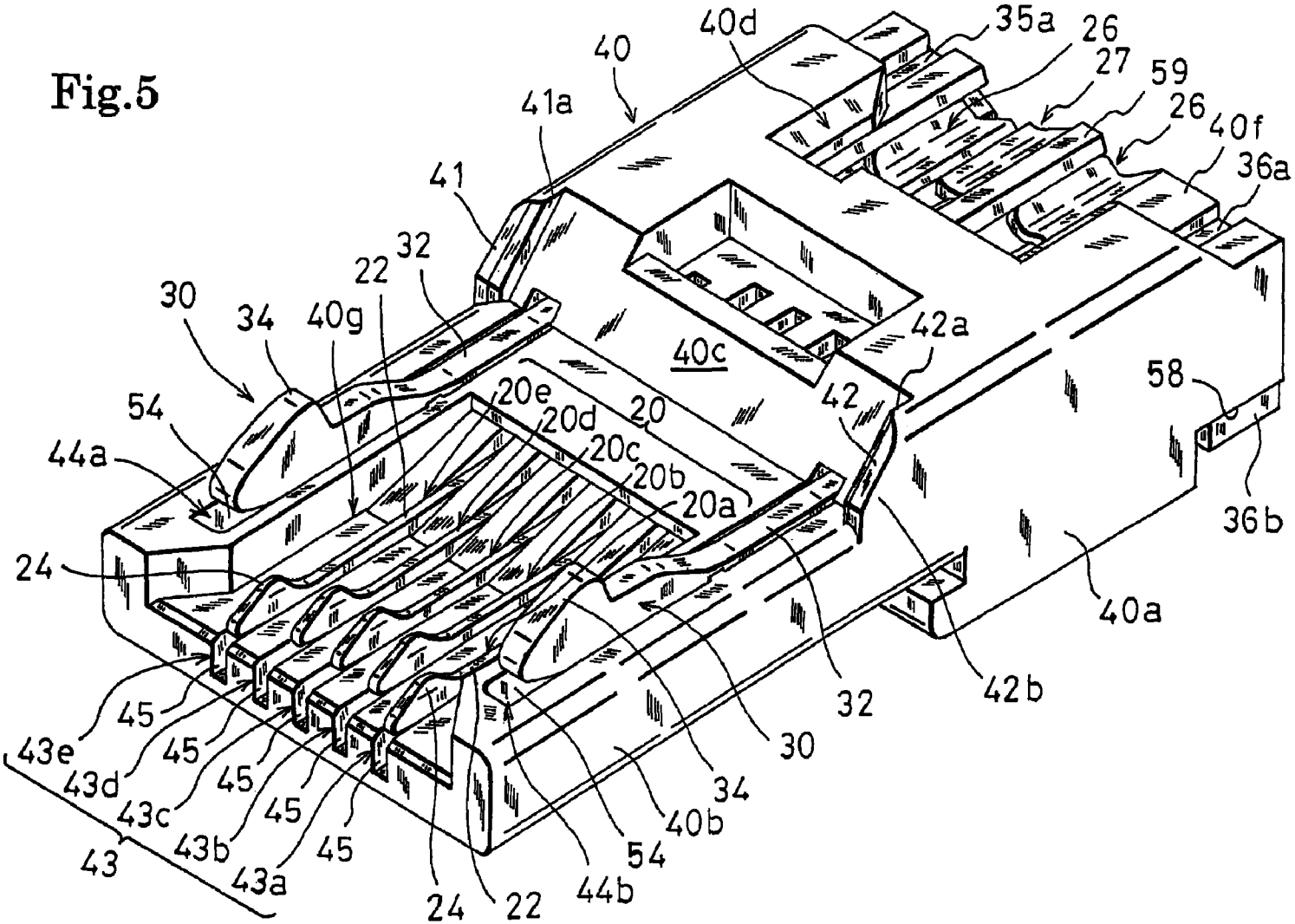
FIG. 5 is a perspective view showing the front, plan, and right side faces of the body of the connector.
Figure 6:
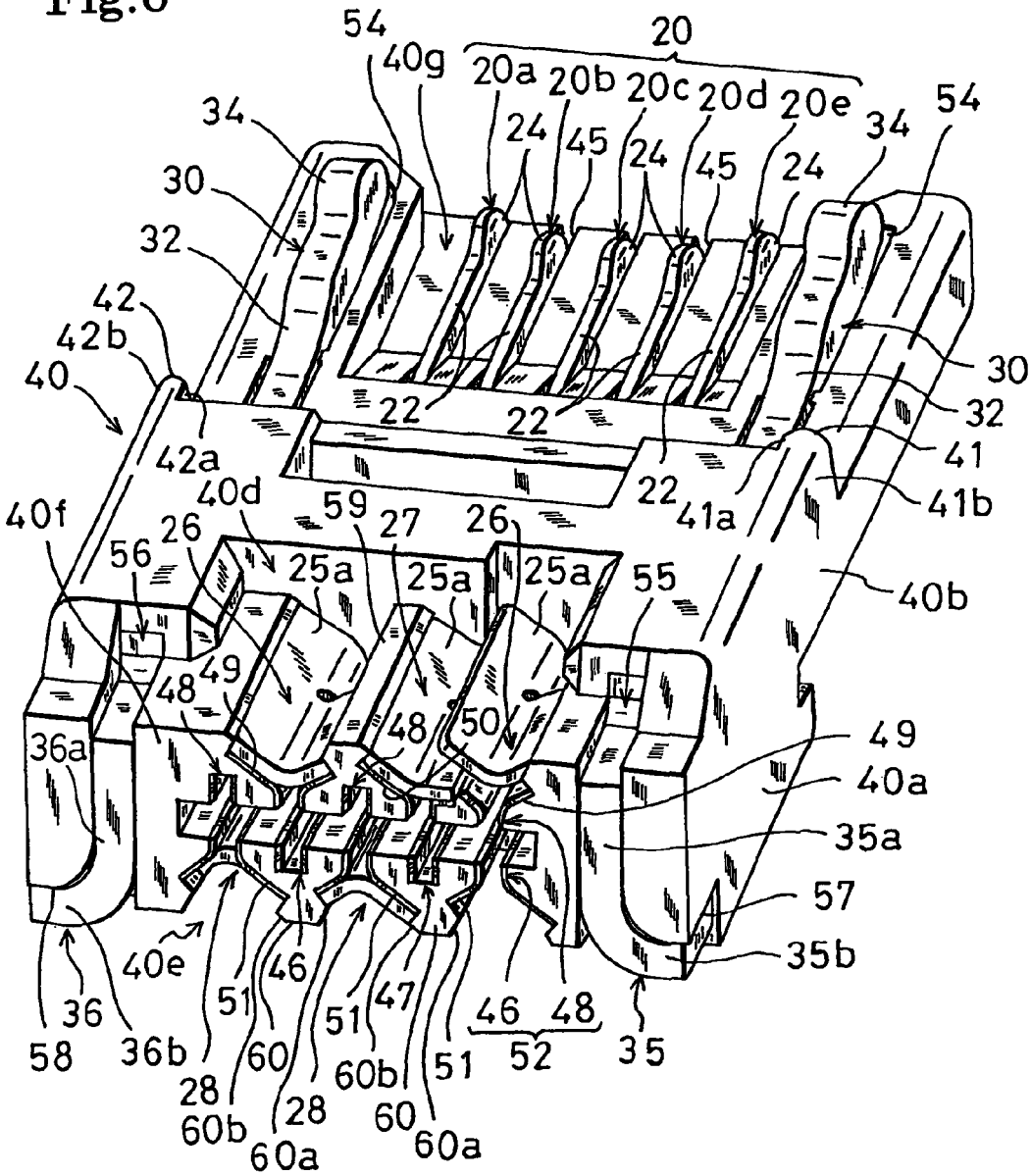
FIG. 6 is a perspective view showing the back, plan, and left side faces of the body of the connector.
Figure 7:
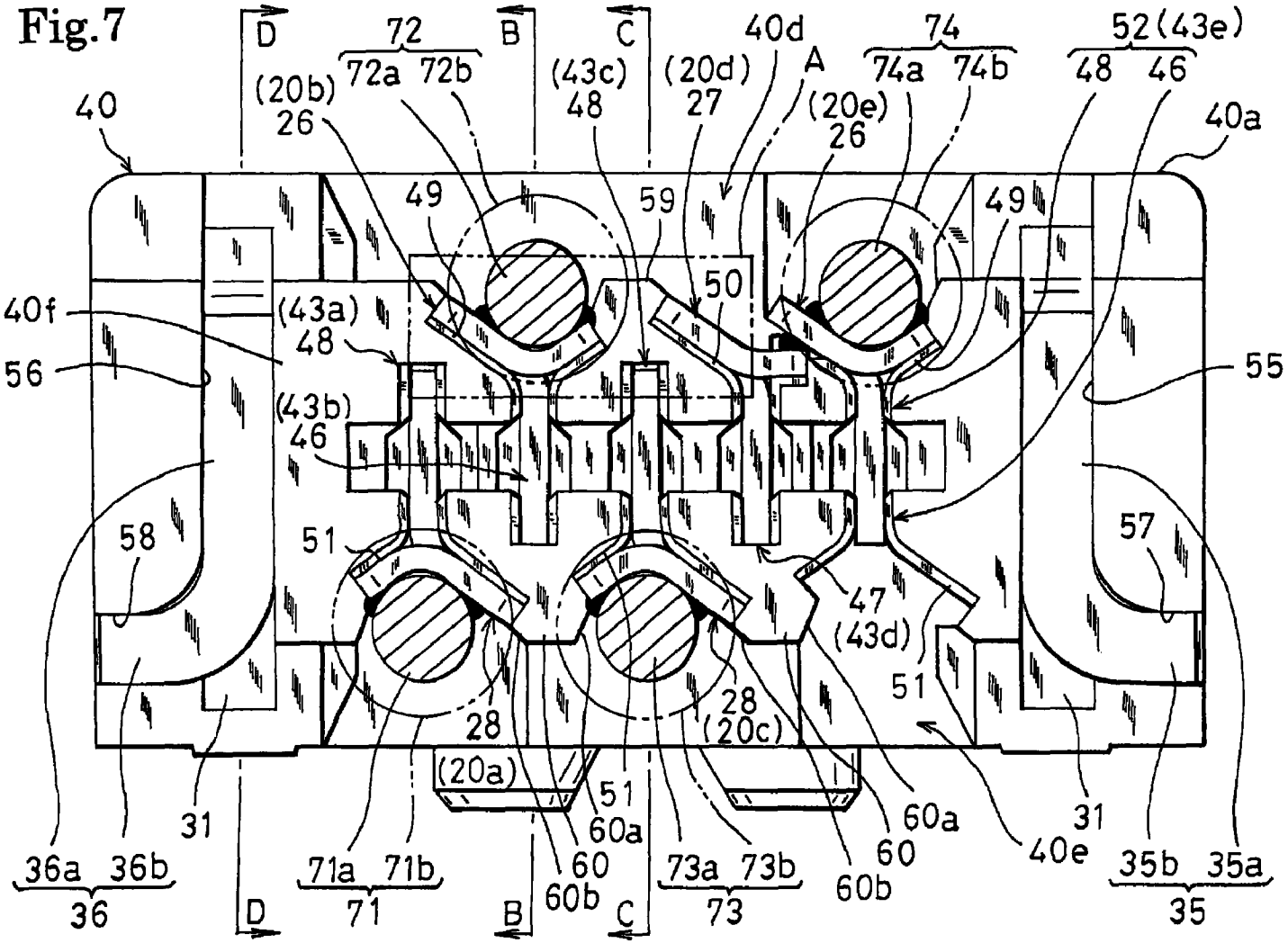
FIG. 7 is a rear view of the body of the connector.
Figure 8:
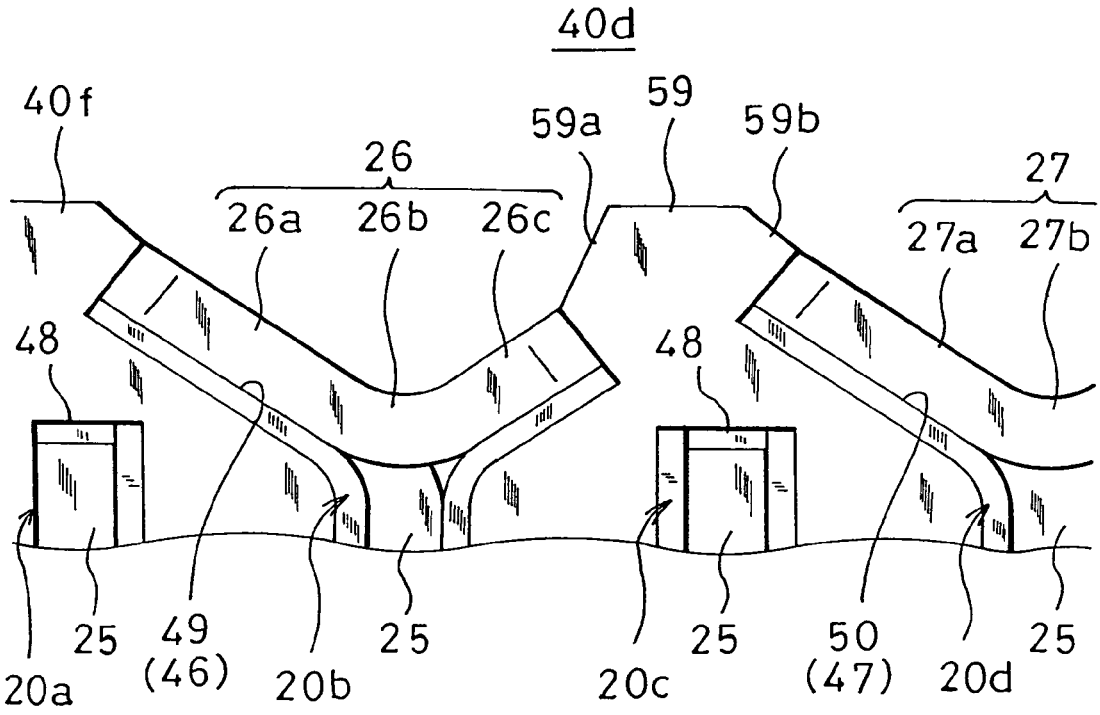
FIG. 8 is an enlarged view of the portion A in FIG. 7.
Figure 9A:
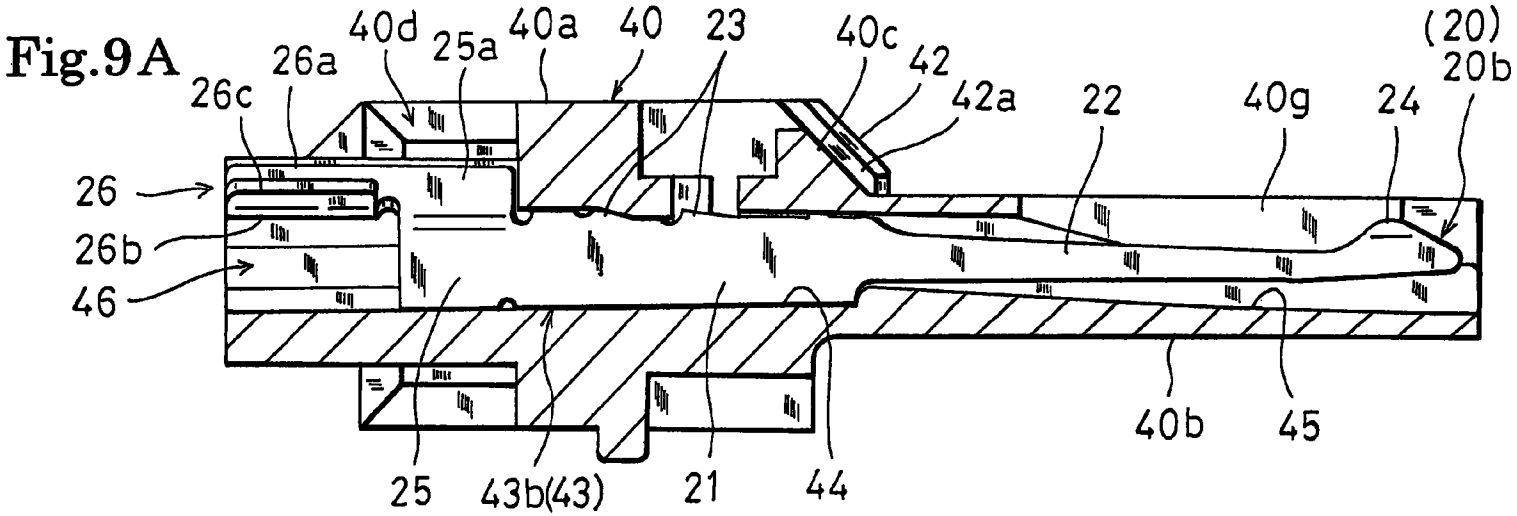
FIG. 9A is a section view taken along the line B-B in FIG. 7.
Figure 9B:
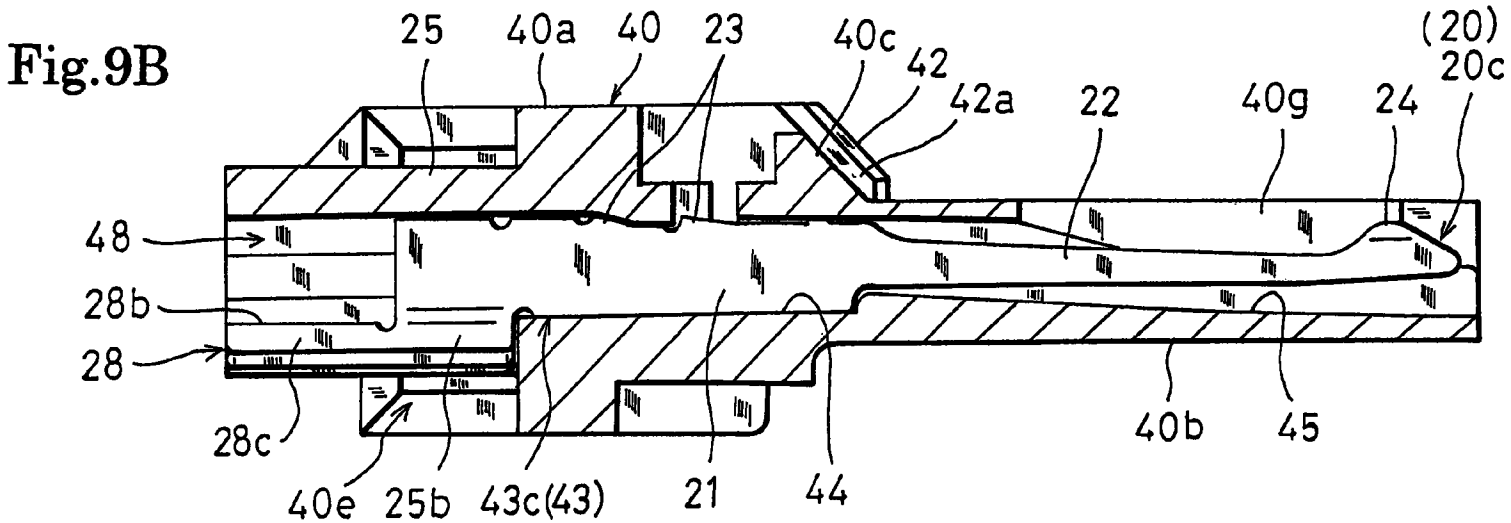
FIG. 9B is a section view taken along the line C-C in FIG. 7.
Figure 10:
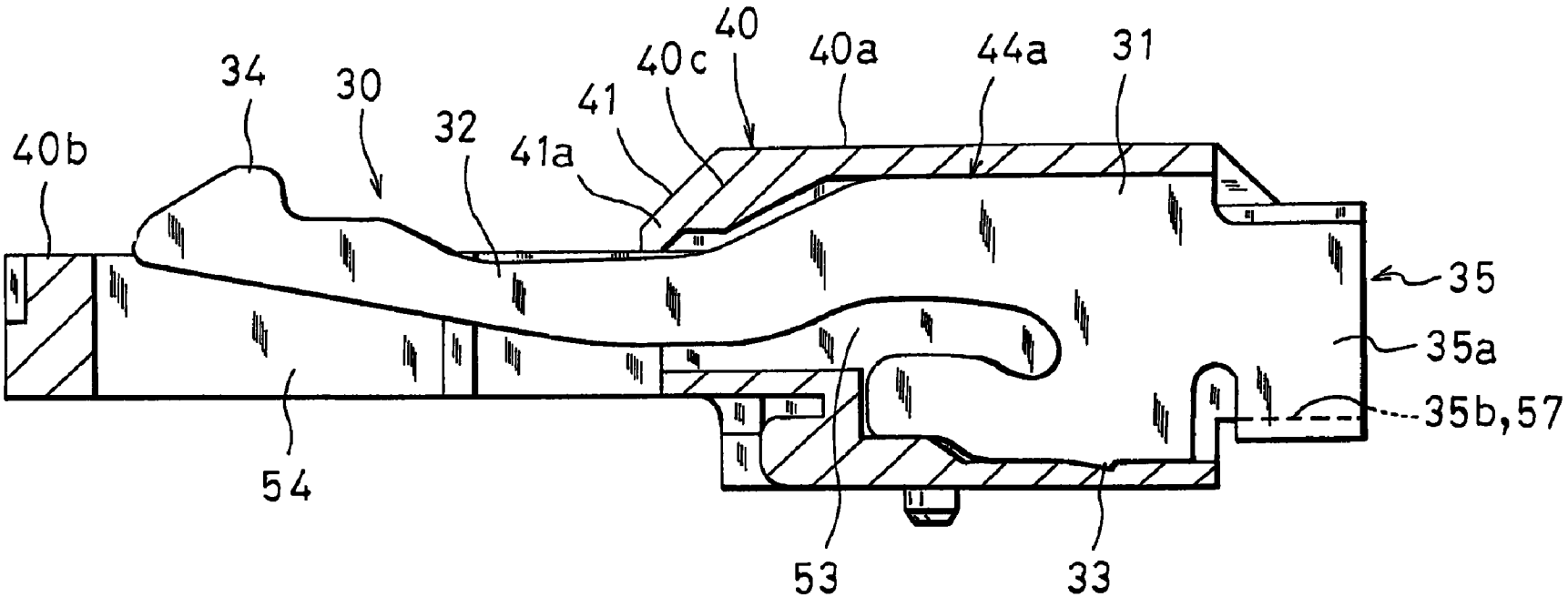
FIG. 10 is a section view taken along the line D-D in FIG. 7.

In FIGS. 1A, 1B, 1C, 2A, and 2B, the reference numeral 1 denotes an A-type micro USB plug (for a cable harness) which cooperates with an AB-type receptacle (counter connector) that is disposed in a portable telephone, a digital camera, a PDA, a portable music player, or the like, and that is not shown, to constitute a micro USB connector which is compliant with the micro USB connector standard. As shown in FIGS. 5, 6, and 7, plural contacts 20 and plural latches (lock springs) 30 are attached to an insulative body 40, and ends of plural lead wires 71, 72, 73, 74 drawn out from an end portion of a cable 70 are connected by soldering to the rear sides of predetermined one of the contacts 20. As shown in FIG. 3, next, the body 40 is shielded by a shell 80 and a shell cover 90, and a plug body 10 is assembled in the end portion of the cable 70. Finally, an over-mold process (insert molding) in which the plug body 10, and a certain length (insert product) of the cable 70 drawn out from the rear side of the plug body 10 are loaded in an injection molding cavity, an insulative resin is poured into the cavity, the range from the end portion of the cable 70 to a root portion of a front fitted portion of the plug body 10 via a rear grip portion of the plug body 10 is enveloped by the molten resin, and the resin is cured to integrate the range is performed to complete the plug as a product.

The reference numeral 2 denotes an over-mold resin (outer skin) of the plug 1, and 3 denotes anti-slip portions which are disposed in the right and left side faces of the over-mold resin 2 in the periphery of the rear grip portion of the plug 1. Patterns (not shown) such as icons indicating the kind of the plug 1 and the insertion direction are formed in the upper and lower faces of the over-mold resin 2 in the periphery of the rear grip portion of the plug 1 so that the plug 1 is normally inserted into a receptacle which is a counter connector.

Therefore, the plug 1 comprises: the plural contacts 20 to which the cable 70 is to be connected; the plural latches 30; the insulative body 40 which holds the contacts 20 and the latches 30; the shielding shell 80 (having the two-piece structure) which covers the body 40; and the over-mold resin 2 which is integrated with the plug body 10 configured by the plural contacts 20, the plural latches 30, the body 40, and the shell 80, and the cable 70, to continuously cover the range from the end portion of the cable 70 to the root portion of the front fitted portion of the plug body 10 via the rear grip portion of the plug body 10.

The plug 1 which is over-molded in this way improves the flex resistance and tensile strength of the cable 70, and the toughness of the plug body 10, and is resistant to abnormal extraction such as extraction in which the cable 70 is pulled, or that in which the plug is diagonally pried, abnormal insertion such as insertion in which the plug is diagonally pried, that in which the plug is forcedly pressed, or reverse insertion, and rough handling.

Next, the components of the plug 1 will be described.

Figure 11:
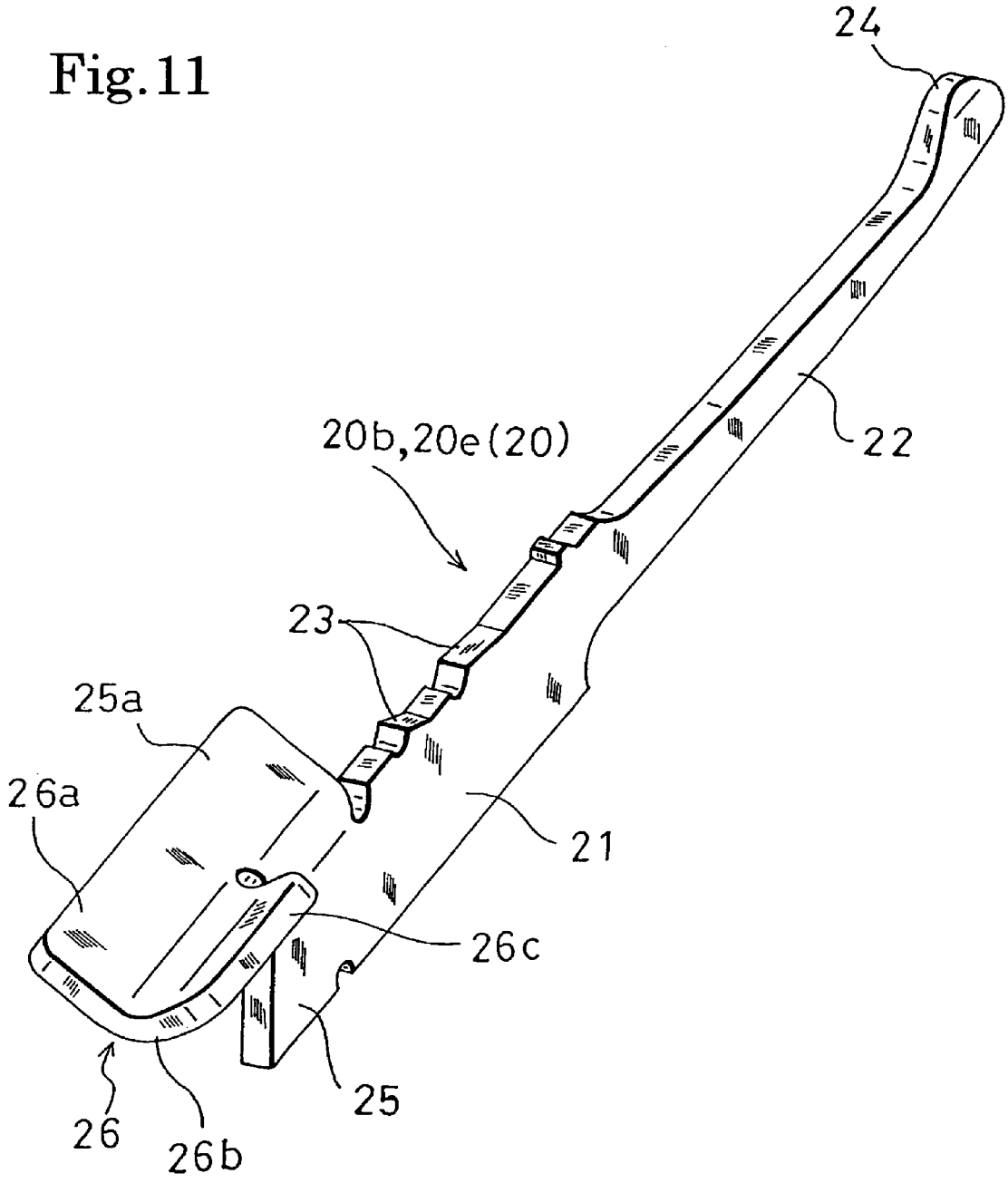
FIG. 11 is a perspective view showing the back, plan, and left side faces of a first contact of the connector.
Figures 12A, 12B, 12C:
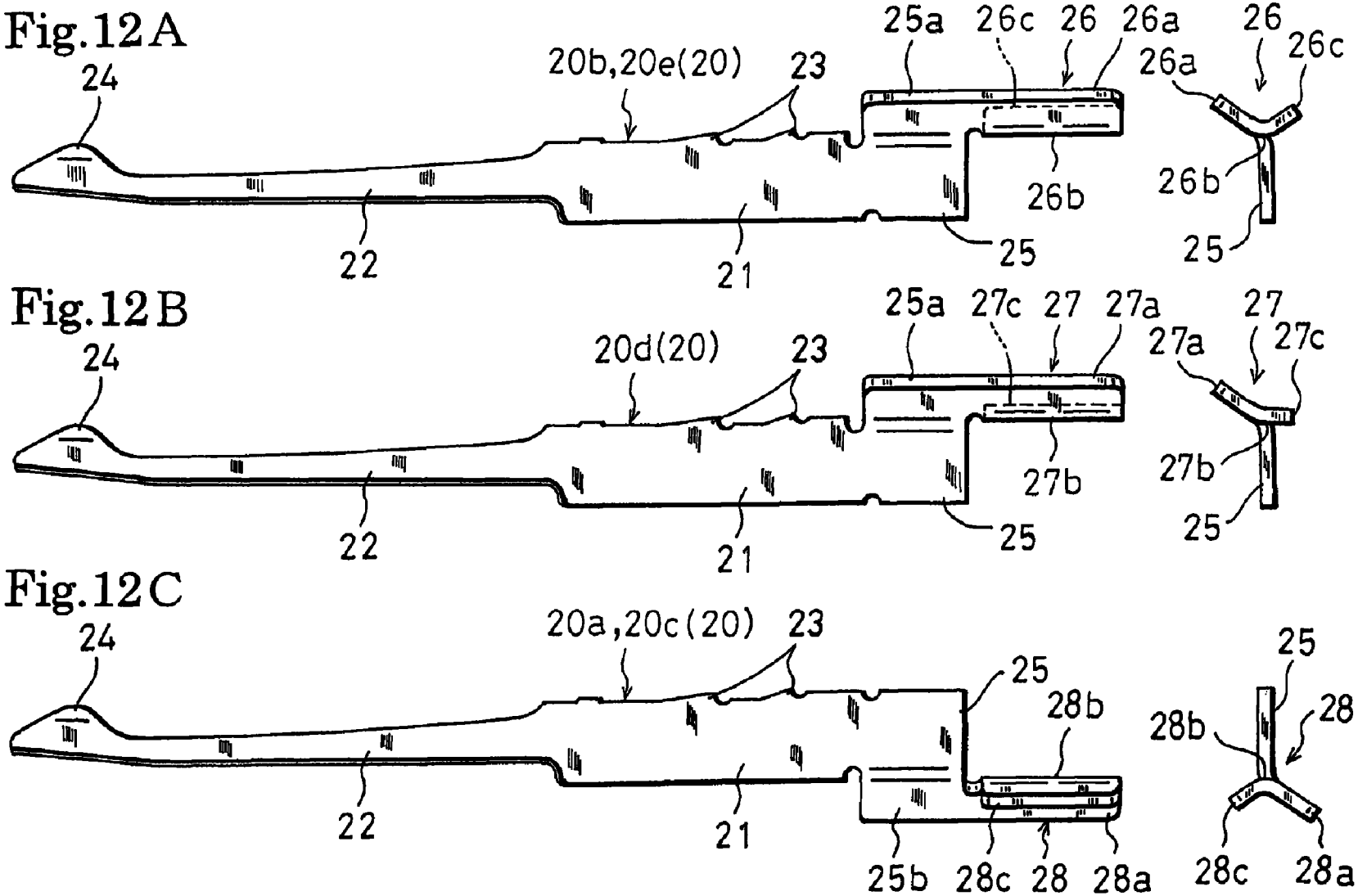
FIG. 12A is right side and rear views of the first contact of the connector.
FIG. 12B is right side and rear views of another first contact.
FIG. 12C is right side and rear views of a second contact.
Figure 13:
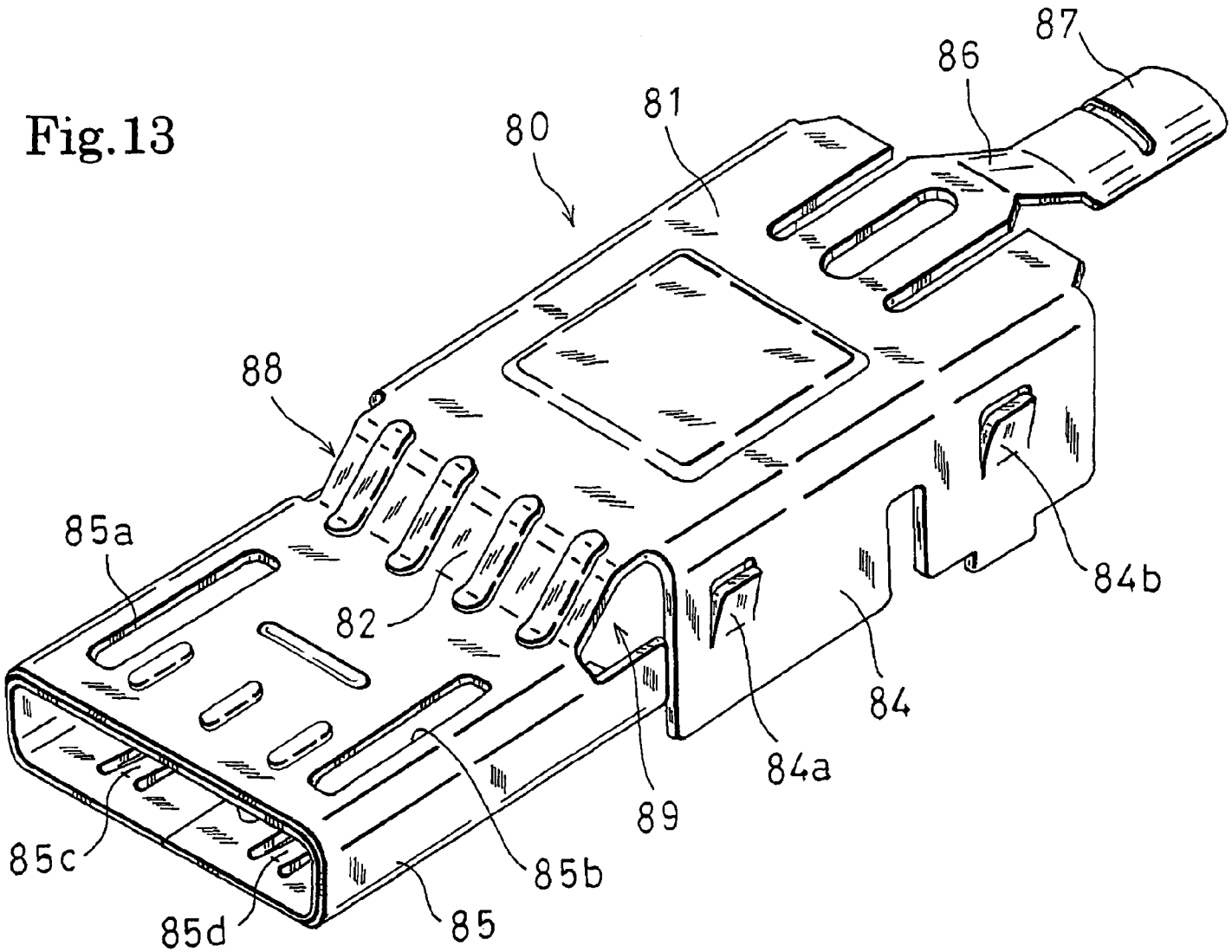
FIG. 13 is a perspective view showing the front, plan, and right side faces of a shell of the connector.
Figures 14A, 14B, 14C, 14D:
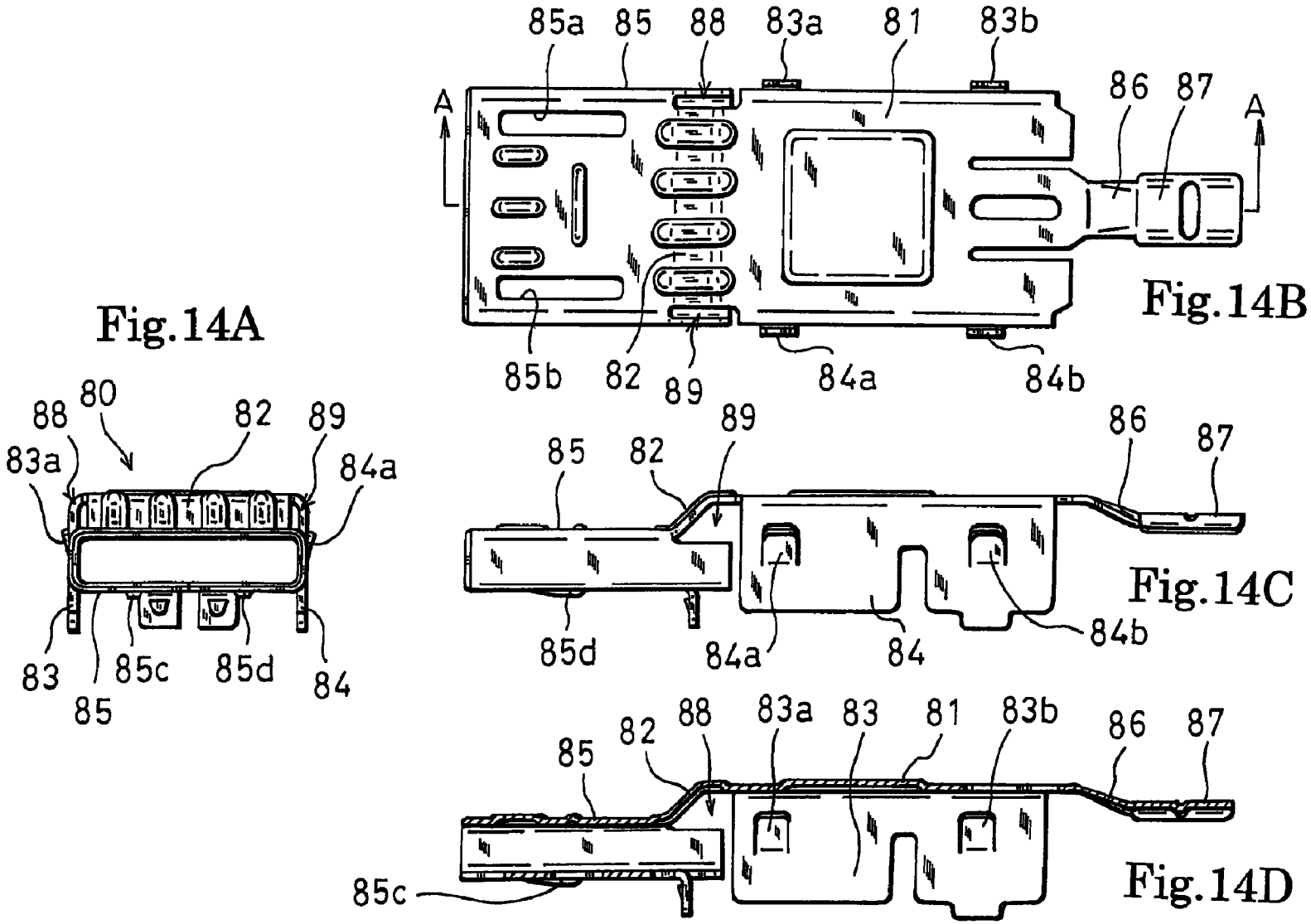
FIG. 14A is a front view of the shell of the connector.
FIG. 14B is a plan view of the shell.
FIG. 14C is a side view of the shell.
FIG. 14D is a section view taken along the line A-A in FIG. 14B.
Figure 15B:
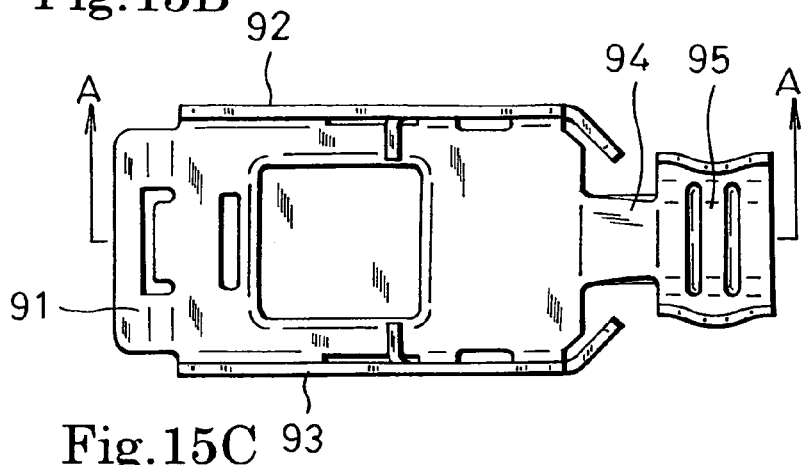
FIG. 15B is a plan view of the shell cover.
Figure 15A:
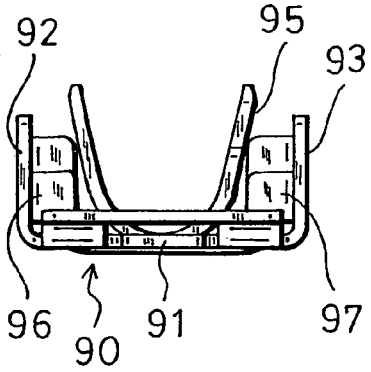
FIG. 15A is a front view of a shell cover of the connector.
Figure 15C:
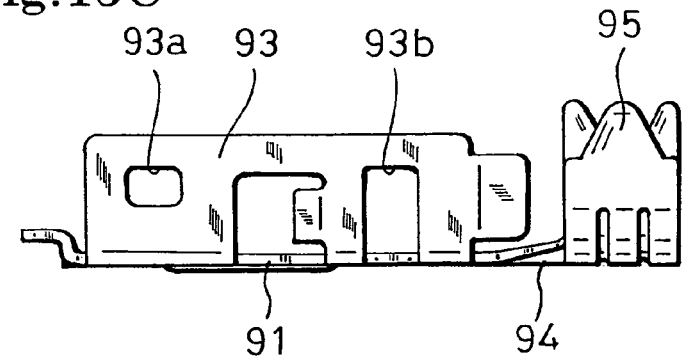
FIG. 15C is a right side view of the shell cover.
Figure 15D:
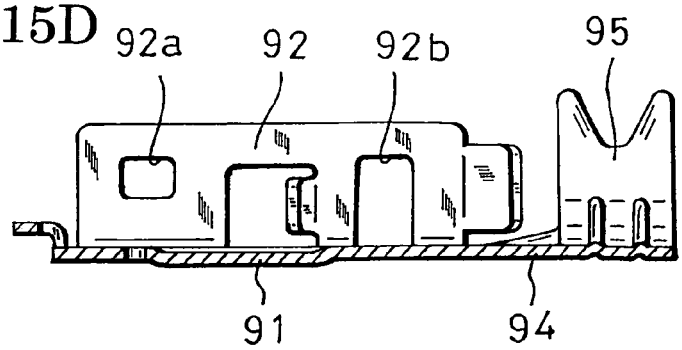
FIG. 15D is a section view taken along the line A-A in FIG. 15B.

The contacts 20 are configured by Nos. 1 to n (No. 1 to 5 in the embodiment) contacts 20*a*, 20*b*, 20*c*, 20*d*, 20*e*. In FIG. 5, the right end contact is No. 1 contact 20*a*, the second, third, and fourth contacts from the right are No. 2 contact 20*b*, No. 3 contact 20*c*, and No. 4 contact 20*d*, respectively, and the left end contact is No. 5 contact 20*e*. The contacts 20 include two kinds consisting of contacts having different rear wire connecting portion shapes, or a first contact shown in FIGS. 11 and 12A and another first contact of the same kind as the first contact and shown in FIG. 12B, and a second contact shown in FIG. 12C. Nos. 2 and 5 contact 20*b*, 20*e* are the first contacts, No. 4 contact 20*d* is the other first contact, and Nos. 1 and 3 contacts 20*a*, 20*c* are the second contacts. The contacts 20 are formed by stamping a thin flat metal plate having a high electric conductivity, and then bending the stamped metal plate, and used while the thickness direction (stamping direction) is made coincident with the lateral direction of the plug 1. The contacts have a length along the anteroposterior direction of the plug 1, a width along the lateral direction, and a height along the vertical direction.

As shown in FIGS. 11, 12A, 12B, and 12C, each of the contacts 20 has a hold portion 21 which is held by the body 40, in the rear side, and a spring portion 22 in the front side. Engagement claws 23 for preventing slipping-off are disposed in an upper portion of the hold portion 21. The spring portion 22 forward extends from the hold portion 21, and has a cantilevered structure in which a rear root portion (a front portion of the hold portion 21) is used as a fulcrum and a front portion is elastically displaceable in the vertical direction.

The contact 20 has a contacting portion 24 which is to be in contact with a contact (not shown) of the receptacle, in the front side, and a terminal portion 25 which is to be connected with the cable 70, in the rear side. The contacting portion 24 is upward projected from a front end portion of the spring portion 22 to be formed into a mountain-like shape. The terminal portion 25 rearward extends from the hold portion 21.

The contacts 20 have wire connecting portions which are expansively opened into a V-like shape in the vertical direction, and to which the lead wires 71, 72, 73, 74 are to be soldered, in the respective terminal portions 25. The wire connecting portions include two kinds consisting of: a first wire connecting portion 26 and other first wire connecting portion 27 which are upward expansively opened; and a second wire connecting portion 28 which is downward expansively opened.

The first wire connecting portion 26 is disposed in Nos. 2 and 5 contacts 20*b*, 20*e* which are the first contacts, and has: one oblique side 26*a* which extends toward the rear side and flushly from an inclined portion 25*a* that is formed by obliquely leftward bending an upper portion of the terminal portion 25 in a rear view at a bending angle of about 55 deg.; and another oblique side 26*c* which upward extends obliquely rightward in a rear side view from a lower portion of the one oblique side 26*a* via a bent portion 26*b* of a bending angle of about 70 deg. The first wire connecting portion is formed into a V-like shape which has a center on the vertical center line of corresponding one of Nos. 2 and 5 contacts 20*b*, 20*e*, and which is expansively opened by about 110 deg. immediately above the terminal portion 25 in a rear view.

The other first wire connecting portion 27 is disposed in No. 4 contact 20*d* which is the other first contact, and has the same structure as the first wire connecting portion 26 except that another oblique side 27*c* extends substantially horizontally and rightward in a rear view from a lower portion of one oblique side 27*a* via a bent portion 27*b* of a bending angle of about 35 deg., the opening angle between the oblique sides 27*a*, 27*c* is slightly larger, and the width of the other oblique side 27*c* is slightly smaller.

The second wire connecting portion 28 is disposed in Nos. 1 and 3 contacts 20*a*, 20*c* which are the second contacts, and has: one oblique side 28*a* which extends toward the rear side and flushly from an inclined portion 25*b* that is formed by obliquely rightward bending a lower portion of the terminal portion 25 in a rear view at a bending angle of about 55 deg.; and another oblique side 28*c* which downward extends obliquely left in a rear view from an upper portion of the one oblique side 28*a* via a bent portion 28*b* of a bending angle of about 70 deg. The second wire connecting portion is formed into an inverted V-like shape which has a center on the vertical center line of corresponding one of Nos. 1 and 3 contacts 20*a*, 20*c*, and which is expansively opened by about 110 deg. immediately below the terminal portion 25 in a rear view.

Therefore, Nos. 2 and 5 contacts 20*b*, 20*e* which are the first contacts, and No. 4 contact 20*d* which is the other first contact have the first wire connecting portion 26 or other first wire connecting portion 27 having a V-like shape which is upward expansively opened on the upper portion of the rear end portion, and are formed into a Y-like shape in a rear view, and Nos. 1 and 3 contacts 20*a*, 20*c* which are the second contacts have the second wire connecting portion 28 having an inverted V-like shape which is downward expansively opened on the lower portion of the rear end portion, and are formed into an inverted Y-like shape in a rear view which is point-symmetrical to the shape in a rear view of No. 2, 5, and 4 contacts 20*b*, 20*e*, and 20*d*.

The latches 30 are configured by a pair of right and left springs having a symmetrical structure. Each of the latches 30 is formed by stamping a flat plate of a metal such as spring stainless steel having a thickness which is about two or three times that of the contacts 20, and then bending the stamped metal plate, and used while the thickness direction (stamping direction) is made coincident with the lateral direction of the plug 1 in the same manner as the contacts 20. The latches have a length along the anteroposterior direction of the plug 1, a width along the lateral direction, and a height along the vertical direction.

As shown in FIGS. 5, 6, 7, and 10, the latches 30 have a hold portion 31 held by the body 40, in the rear side, and a spring portion 32 in the front side. The hold portion 31 is formed into a substantially U-like shape in a side view which is forward opened, and an engagement claw 33 for preventing slipping-off is disposed in a lower portion. The spring portion 32 forward extends from the upper piece of the hold portion 31, and has a cantilevered structure in which a rear root portion of the upper piece of the hold portion 31 is used as a fulcrum and a front portion is elastically displaceable in the vertical direction.

The latches 30 have an engaging portion 34 which is to be engaged with an engaging portion (not shown) of the receptacle, in the front side. One of a pair of rotation restricting portions 35, 36 having a bilaterally symmetrical structure is disposed on the rear side of one of the latches 30, and the other rotation restricting portion is disposed on the rear side of the other latch 30. The engaging portion 34 is upward projected from a front end portion of the spring portion 32 to be formed into a mountain-like shape. The one rotation restricting portion 35 has: a vertical piece 35*a* which rearward extends from and flushly with the hold portion 31 of the latch 30 which is on the left side in FIG. 5; and an engaging piece 35*b* which extends substantially horizontally from a lower portion of the vertical piece 35*a* toward the right side in a rear view, to be formed into an L-like shape. The other rotation restricting portion 36 has: a vertical piece 36*a* which rearward extends from and flushly with the hold portion 31 of the latch 30 which is on the right side in FIG. 5; and an engaging piece 36*b* which extends substantially horizontally from a lower portion of the vertical piece 36*a* toward the left side in a rear view, to be formed into an L-like shape which is bilaterally symmetric to that of the one rotation restricting portion 35.

Therefore, the pair of latches 30 are different only in the shape of the rotation restricting portion in the rear side, and have the bilaterally symmetrical structure.

The body 40 is an injection molded product made of an insulative resin. As shown in FIGS. 5, 6, 7, 9A, 9B, and 10, the body has a rectangular parallelepiped grip portion 40*a* which is to be gripped by a hand when the plug 1 is inserted or extracted, in the rear side, and a fitting portion 40*b* which is to be inserted into the receptacle, in the front side. The fitting portion 40*b* has a rectangular parallelepiped shape which is thinner than the grip portion 40*a*, and forward extends integrally from a vertically middle position of the grip portion 40*a*. The front end face of the grip portion 40*a* which is above the fitting portion 40*b*, and which constitutes a step face between the upper face of the grip portion 40*a* and that of the fitting portion 40*b* is formed into an inclined face 40*c* which is obliquely rearward inclined by about 45 deg.

The body 40 has: a first soldering space 40*d* which is formed by a cutout in the upper face of a rear portion of the grip portion 40*a*, which houses ends of the lead wires 72, 74 to be soldered to the first wire connecting portions 26, and which is opened upward and rearward; a second soldering space 40*e* which is formed by a cutout in the lower face of a rear portion of the grip portion 40*a*, which houses ends of the lead wires 71, 73 to be soldered to the second wire connecting portions 28, and which is opened downward and rearward; a wall 40*f* which is formed between the spaces 40*d*, 40*e*; and a recess 40*g* which is formed by a cutout in the upper face of a front portion of the fitting portion 40*b*, into which the contacts of the receptacle are to be inserted, and which is opened upward and forward. The front shape of the fitting portion 40*b* is recessed by the recess 40*g*.

The body 40 has right and left sealing portions 41, 42 which are fitted into gaps (described later) of the shell 80 to close the gaps, in right and left side portions of the inclined face 40*c*. The sealing portions 41, 42 will be described later in detail.

Furthermore, the body 40 has: plural contact attachment grooves 43 to which the contacts 20 are attached; and a pair of latch attachment grooves 44*a*, 44*b* to which the latches 30 are attached, and which have a bilaterally symmetrical structure. The contact attachment grooves 43 are configured by Nos. 1 to 5 contact attachment grooves 43*a*, 43*b*, 43*c*, 43*d*, 43*e* correspondingly with the contacts 20. In FIG. 5, the right end groove is No. 1 contact attachment groove 43*a*, the second, third, and fourth grooves from the right are No. 2 contact attachment groove 43*b*, No. 3 contact attachment groove 43*c*, and No. 4 contact attachment groove 43*d*, respectively, and the left end groove is No. 5 contact attachment groove 43*e*. The contact attachment grooves 43 include two kinds consisting of contact attachment grooves having different rear contact insertion port shapes correspondingly with the contacts 20, namely, a first contact attachment groove and other first contact attachment groove which have a Y-like shape in a rear view as shown in FIGS. 6 and 7 correspondingly with the first contacts and the other first contact, and a second contact attachment groove which has an inverted Y-like shape correspondingly with the second contacts. Nos. 2 and 5 contact attachment grooves 43*b*, 43*e* are the first contact attachment groove, No. 4 contact attachment groove 43*d* is the other first contact attachment groove, and Nos. 1 and 3 contact attachment grooves 43*a*, 43*c* are the second contact attachment grooves.

The contact attachment grooves 43 have a width which is slightly larger than the thickness of the contacts 20, are juxtaposed at a constant pitch in the lateral direction within the width of the wall 40*f* of the body 40, and within the width of the recess 40*g*, extend in parallel in the anteroposterior direction over the range from the rear end face of the wall 40*f* to the front end face of the fitting portion 40*b*, and are formed over the whole length of the body 40. The whole lengths of the corresponding contacts 20 are inserted into the grooves from the rear side of the body 40, to be attached thereto.

The contact attachment grooves 43 have a hold portion attachment portion 44 which fixes and holds the hold portion 21 of the corresponding contact 20, in the rear side, and a spring portion attachment portion 45 which houses the spring portion 22 of the contact 20, in the front side. The hold portion attachment portions 44 have a hole structure in which the periphery is closed by the resin of the grip portion 40*a*. The spring portion attachment portions 45 forward extend from the hold portion attachment portions 44 to be disposed in the fitting portion 40*b* so that front end portions are opened in the front end faces of the fitting portion 40*b*, and upper portions are opened in the recess 40*g*.

The contact attachment grooves 43 have contact insertion ports which hold the terminal portions 25 of the contacts 20 and the wire connecting portions, in the rear side. The contact insertion ports include two kinds consisting of: first contact insertion ports 46 into which Nos. 2 and 5 contacts 20*b*, 20*e* that are the first contacts are inserted, and another first contact insertion port 47 into which No. 4 contact 20*d* that is the other first contact is inserted; and second contact insertion ports 48 into which No. 1 and 3 contacts 20*a*, 20*c* that are the second contacts are inserted.

The first contact insertion ports 46 are formed into a Y-like shape corresponding to the shape in a rear view of Nos. 2 and 5 contacts 20*b*, 20*e*, and disposed in Nos. 2 and 5 contact attachment grooves 43*b*, 43*e* which are the first contact attachment grooves. The first contact insertion ports 46 rearward extend from the hold portion attachment portions 44 of Nos. 2 and 5 contact attachment grooves 43*b*, 43*e*, and are formed in the wall 40*f* so that rear end portions are opened in the rear end face of the wall 40*f*, and upper portions are opened in the first soldering space 40*d*, thereby forming V-shaped first grooves 49 in the upper face (the bottom face of the first soldering space 40*d*) of the wall 40*f*. The first grooves support the upper inclined portions 25*a* of the terminal portions 25 of Nos. 2 and 5 contacts 20*b*, 20*e*, and the first wire connecting portions 26, from the back side (the lower side).

The other first contact insertion port 47 is formed into a Y-like shape corresponding to the shape in a rear view of No. 4 contact 20*d*, and disposed in Nos. 4 contact attachment groove 43*d* which is the other first contact attachment groove. The other first contact insertion port 47 rearward extends from the hold portion attachment portion 44 of No. 4 contact attachment groove 43*d*, and is formed in the wall 40*f* so that a rear end portion is opened in the rear end face of the wall 40*f*, and an upper portion is opened in the first soldering space 40*d*, thereby forming a V-shaped other first groove 50 in the upper face of the wall 40*f*. The other first groove 50 supports the upper inclined portion 25*a* of the terminal portion 25 of No. 4 contact 20*d*, and the other first wire connecting portion 27, from the back side.

The second contact insertion ports 48 are formed into an inverted Y-like shape corresponding to the shape in a rear view of Nos. 1 and 3 contacts 20*a*, 20*c*, and disposed in Nos. 1 and 3 contact attachment grooves 43*a*, 43*c* which are the second contact attachment grooves. The second contact insertion ports 48 rearward extend from the hold portion attachment portions 44 of Nos. 1 and 3 contact attachment grooves 43*a*, 43*c*, and are formed in the wall 40*f* so that rear end portions are opened in the rear end face of the wall 40*f*, and lower portions are opened in the second soldering space 40*e*, thereby forming inverted V-shaped second grooves 51 in the lower face (the top face of the second soldering space 40*e*) of the wall 40*f*. The second grooves support the lower inclined portions 25*b* of the terminal portions 25 of Nos. 1 and 3 contacts 20*a*, 20*c*, and the second wire connecting portions 28, from the back side (the upper side).

In No. 5 contact attachment groove 43*e* which is the first contact attachment groove, an upper I-like portion (a portion into which the hold portions 21, the spring portions 22, the contacting portions 24, and the terminal portions 25 of Nos. 1 and 3 contacts 20*a*, 20*c* which are the second contacts are inserted) of the second contact insertion port 48 is superimposed on a lower I-like portion (a portion into which the hold portions 21, the spring portions 22, the contacting portions 24, and the terminal portions 25 of Nos. 2 and 5 contacts 20*b*, 20*e* which are the first contacts are inserted) of the first contact insertion port 46, thereby forming the second contact insertion port 48. Specifically, No. 5 contact attachment groove 43*e* is configured as a first/second contact common attachment groove which functions as both the first and second contact attachment grooves, which has a first/second contact common insertion port 52 that functions as both the first contact insertion port 46 and the second contact insertion port 48, and in which an upper portion of the first/second contact common insertion port 52 is opened in the first soldering space 40*d* to form the first groove 49 in the upper face of the wall 40*f*, and a lower portion of the first/second contact common insertion port 52 is opened in the second soldering space 40*e* to form the second groove 51 in the lower face of the wall 40*f*, whereby the whole lengths of the first and second contacts are enabled to be alternatively inserted into the groove.

The latch attachment grooves 44*a*, 44*b* have a width which is slightly larger than the thickness of the latches 30, are disposed in right and left side portions of the body 40 across the contact attachment grooves 43, respectively, and extend in the anteroposterior direction in parallel to the contact attachment grooves 43. The whole lengths of the corresponding latches 30 are inserted into the latch attachment grooves from the rear side of the body 40 to be attached thereto.

The latch attachment grooves 44*a*, 44*b* have a hold portion attachment portion 53 which fixes and holds the hold portion 31 of the corresponding latch 30, and, in the front side, a spring portion attachment portion 54 which houses the spring portion 32 of the latch 30. The hold portion attachment portions 53 have a hole structure in which the periphery is closed by the resin of the grip portion 40*a*. The spring portion attachment portions 54 forward extend from the hold portion attachment portions 53 to be disposed laterally outside the recess 40*g* of the fitting portion 40*b* so that upper and lower portions are opened in the upper and lower faces of the fitting portion 40*b*, and front end portions do not reach the front end face of the fitting portion 40*b* to be located slightly behind the front end face.

In the latch attachment grooves 44*a*, 44*b*, one of a pair of latch insertion ports 55, 56 which house the rotation restricting portions 35, 36 of the latches 30, respectively, and which have a bilaterally symmetrical structure is disposed in the rear side of the one latch attachment groove 44*a*, and the other latch insertion port is disposed in the rear side of the other latch attachment groove 44*b*. The one latch insertion port 55 is formed into an L-like shape which corresponds to the shape of the rotation restricting portion 35 of the latch 30 which is on the left side in FIG. 5, and extends toward the rear side from the hold portion attachment portions 53 of the latch attachment groove 44*a* which is on the left side in FIG. 5, to be formed on the left side with respect to the wall 40*f*, a rear end portion is opened in the rear end face of the body 40, and a lower portion is opened in the lower face of the body 40 to, on the rear lower face of the body 40, form an engaging face 57 against which the engaging piece 35*b* of the one rotation restricting portion 35 butts from the lower side. The other latch insertion port 56 is formed into an L-like shape which corresponds to the shape of the rotation restricting portion 36 of the latch 30 which is on the right side in FIG. 5, and extends toward the rear side from the hold portion attachment portion 53 of the latch attachment groove 44*b* which is on the right side in FIG. 5, to be formed on the right side with respect to the wall 40*f*, a rear end portion is opened in the rear end face of the body 40, and a lower portion is opened in the lower face of the body 40 to, on the rear lower face of the body 40, form an engaging face 58 against which the engaging piece 36*b* of the other rotation restricting portion 36 butts from the lower side.

Then, the whole lengths of No. 1 to 5 contacts 20*a*, 20*b*, 20*c*, 20*d*, 20*e* are inserted respectively into Nos. 1 to 5 contact attachment-grooves 43*a*, 43*b*, 43*c*, 43*d*, 43*e* from the rear side of the body 40 through the first, other first, and second contact insertion ports 46, 47, 48, thereby juxtaposedly attaching the plural contacts 20 to the body 40 at a constant pitch in the lateral direction, and the whole lengths of the paired right and left latches 30 are inserted respectively into the paired right and left latch attachment grooves 44*a*, 44*b* from the rear side of the body 40 through the latch insertion ports 55, 56, thereby juxtaposedly attaching the pair of latches 30 to the body 40 across the plural contacts 20 therebetween.

In the attached state, the contacts 20 are fixed and held to the body 40 in a state where the hold portions 21 are press inserted into the hold portion attachment portions 44 and locked by biting of the engagement claws 23 into the resin of the grip portion 40*a*, the spring portions 22 are housed in the spring portion attachment portions 45 in a vertically elastically displaceable manner, and the contacting portions 24 are projected and juxtaposed in the recess 40*g* of the fitting portion 40*b* at a constant pitch in the lateral direction.

The terminal portions 25 and first wire connecting portions 26 of Nos. 2 and 5 contacts 20*b*, 20*e* are inserted and placed in the first contact insertion ports 46 of Nos. 2 and 5 contact attachment grooves 43*b*, 43*e* in a state where the front end faces of the inclined portions 25*a* of the terminal portions 25 butt against a front peripheral wall face of the first soldering space 40*d*, the rear faces of the inclined portions 25*a* of the terminal portions 25 and the first wire connecting portions 26 are supported by the first grooves 49 from the back side, and the surfaces are exposed from the lower portion of the first soldering space 40*d*. The terminal portion 25 and other first wire connecting portion 27 of No. 4 contact 20*d* are inserted and placed in the other first contact insertion port 47 of No. 4 contact attachment groove 43*d* in a state where the front end face of the inclined portion 25*a* of the terminal portion 25 butt against the front peripheral wall face of the first soldering space 40*d*, the rear faces of the inclined portion 25*a* of the terminal portion 25 and the other first wire connecting portion 27 are supported by the other first groove 50 from the back side, and the surfaces are exposed from the lower portion of the first soldering space 40*d*. The terminal portions 25 and second wire connecting portions 28 of Nos. 1 and 3 contacts 20*a*, 20*c* are inserted and placed in the second contact insertion ports 48 of Nos. 1 and 3 contact attachment grooves 43*a*, 43*c* in a state where the front end faces of the inclined portions 25*b* of the terminal portions 25 butt against a front peripheral wall face of the second soldering space 40*e*, the rear faces of the inclined portions 25*b* of the terminal portions 25 and the second wire connecting portions 28 are supported by the second grooves 51 from the back side, and the surfaces are exposed from the upper portion of the second soldering space 40*e*. Therefore, the wire connecting portions 26, 27, 28 are arranged in a staggered manner in two or upper and lower stages in rear of the contacts 20 which are juxtaposed in the pitch direction, and, with respect to No. 5 contact 20*e* which is an end contact in one outermost side in the pitch direction, the first contact of the same kind as No. 4 contact 20*d* which is inward adjacent is placed. In the first wire connecting portion 26 of No. 5 contact 20*e*, the one oblique side 26*a* on the side of No. 4 contact 20*d* is obliquely projected to the side above the other oblique side 27*c* on the side of No. 5 contact 20*e* of the other first wire connecting portion 27 of No. 4 contact 20*d*.

The work of connecting the lead wires 71, 72, 73, 74 to the contacts 20 which are attached to the body 40 in this way is conducted in the following steps: a step in which the body 40 is held in the state (the state of FIG. 7) where the first wire connecting portions 26 and the other first wire connecting portion 27 are upward expansively opened, in the first soldering space 40*d*, ends of the corresponding lead wires 72, 74 (core wires 72*a*, 74*a* from which insulative outer skins 72*b*, 74*b* are removed by a peeling process) are placed on the first wire connecting portions 26, and solder is applied to the ends, whereby the corresponding lead wires 72, 74 are connected to Nos. 2 and 5 contacts 20*b*, 20*e*, and, at this time, solder is applied also to the other first wire connecting portion 27 to short-circuit the first wire connecting portions 27, 26 of Nos. 4 and 5 contacts 20*d*, 20*e* with each other; and a step in which the body 40 is held in the state (the state where the body 40 is inverted from the state of FIG. 7) where the second wire connecting portions 28 are upward expansively opened, in the second soldering space 40*e*, ends of the corresponding lead wires 71, 73 (core wires 71*a*, 73*a* from which insulative outer skins 71*b*, 73*b* are removed by a peeling process) are placed on the second wire connecting portions 28, and solder is applied to the ends, whereby the corresponding lead wires 71, 73 are connected to Nos. 1 and 3 contacts 20*a*, 20*c*.

As shown FIGS. 5, 6, 7, and 8, the body 40 has: between the first groove 49 formed by the first contact insertion port 46 of No. 2 contact attachment groove 43*b* and the other first groove 50 formed by the other first contact insertion port 47 of No. 4 contact attachment groove 43*d*, a first bank 59 which is upward projected in a gap between the upper inclined portion 25*a* of the terminal portion 25 and first wire connecting portion 26 of No. 2 contact 20*b* which is supported by the first groove 49, and the upper inclined portion 25*a* of the terminal portion 25 and other first wire connecting portion 27 of No. 4 contact 20*d* which is supported by the other first groove 50, to be higher than the inclined portions 25*a* and the first and other first wire connecting portions 26, 27; and, between the three second grooves 51 formed by the second contact insertion ports 48 of Nos. 1, 3, and 5 contact attachment grooves 43*a*, 43*c*, 43*e*, second banks 60 which are downward projected in gaps between the lower inclined portions 25*b* and second wire connecting portions 28 of the terminal portions 25 of Nos. 1 and 3 contacts supported by the second grooves 51, and on the side of No. 5 contact 20*e* of the lower inclined portion 25*b* and second wire connecting portion 28 of the terminal portion 25 of No. 3 contact, to be lower than the inclined portions 25*b* and the second wire connecting portions 28. The first bank 59 prevents a solder bridge from being formed between the first wire connecting portion 26 of No. 2 contact 20*b* and the adjacent other first wire connecting portion 27 when the end of the lead wire 72 is soldered to the first wire connecting portion 26. The second bank 60 which is projected between the adjacent second wire connecting portions 28 prevents a solder bridge from being formed between the adjacent second wire connecting portions 28 of Nos. 1 and 3 contacts 20*a*, 20*c* when the ends of the lead wires 71, 73 are soldered to the second wire connecting portions 28. The second bank 60 which is on the side of No. 5 contact 20*e* of the lower inclined portion 25*b* and second wire connecting portion 28 of the terminal portion 25 of No. 3 contact prevents a part of solder from flowing from the empty second groove 51 into the first/second contact common insertion port 52 of No. 5 contact attachment groove 43*e* when the end of the lead wire 73 is soldered to the second wire connecting portion 28 of No. 3 contact 20*c*.

The both side faces of the first bank 59 are formed as inclined faces 59*a*, 59*b* which rise from the surface of the other oblique side 26*c* of the one first wire connecting portion 26 and that of the one oblique side 27*a* of the other first wire connecting portion 27 which is adjacent to the one first wire connecting portion across the first bank 59, with a steeper inclination angle than the oblique sides 26*c*, 27*a*. The both side faces of the second bank 60 which is projected between the adjacent second wire connecting portions 28 are formed as inclined faces 60*a*, 60*b* which rise from the surface of the one oblique side 28*a* of the one adjacent second wire connecting portion 28 and that of the other oblique side 28*c* of the other second wire connecting portion 28 which is adjacent to the one second wire connecting portion across the second bank 60, with a steeper inclination angle than oblique sides 28*a*, 28*c*. Other inclined faces 60*a*, 60*b* identical with the inclined faces are formed on the both side faces of the second bank 60 which is on the side of No. 5 contact 20*e* of the lower inclined portion 25*b* and second wire connecting portion 28 of the terminal portion 25 of No. 3 contact.

In the body 40, the first bank 59 is not formed between the other first groove 50 formed by the other first contact insertion port 47 of No. 4 contact attachment groove 43*d*, and the first groove 49 formed by the first contact insertion port 46 of No. 5 contact attachment groove 43*e*. According to the configuration, when the end of the lead wire 74 is soldered to the first wire connecting portion 26 of No. 5 contact 20*e*, a part of solder flows into the other first wire connecting portion 27 of No. 4 contact 20*d*, and the first wire connecting portions 27, 26 of Nos. 4 and 5 contacts 20*d*, 20*e* can be short-circuited with each other by the part of solder.

In the above-described configuration, the plug 1 comprises: the plural contacts 20 which are juxtaposed in the pitch direction; and the insulative body 40 which holds the contacts 20, the contacts 20 have: the contacting portions 24 which are to be contacted with the contacts of the receptacle; the hold portions 21 which are held by the body 40; and the terminal portion 25 which are to be connected to the lead wires 71, 72, 73, 74 drawn out from the cable 70, and the terminal portion 25 have the wire connecting portions 26, 27, 28 to which the lead wires 71, 72, 73, 74 are to be soldered, while the wire connecting portions are expansively opened along the thickness direction of the plug 1 which is perpendicular to: the insertion/extraction direction of the plug 1 with respect to the receptacle; and the pitch direction perpendicular to the insertion/extraction direction. Since the wire connecting portions 26, 27, 28 are expansively opened along the thickness direction of the plug 1, the workability of soldering of the lead wires 71, 72, 73, 74 can be improved and the solder strength can be enhanced while preventing a phenomenon that molten solder drips from the wire connecting portions to form a solder bridge between adjacent contacts, from occurring. Furthermore, the wire connecting portions 26, 27, 28 can be expansively opened along the thickness direction of the plug 1 within the plug size which is equivalent to a conventional plug, without increasing the pitch interval of the contacts 20 or separating the positions of the wire connecting portions 26, 27, 28 in the thickness direction of the plug 1.

The wire connecting portions 26, 27, 28 are expansively opened along the thickness direction of the plug 1 while being formed into a V-like shape. Because of the V-like shape of the wire connecting portions, the workability of soldering of the lead wires 71, 72, 73, 74 can be improved and the solder strength can be enhanced while pre-venting the phenomenon that molten solder drips from the wire connecting portions 26, 27, 28 to form a solder bridge between adjacent contacts, from occurring. Furthermore, the wire connecting portions can be formed into a V-like shape within a plug size which is equivalent to a conventional plug, without increasing the pitch interval of the contacts 20 or separating the positions of the wire connecting portions 26, 27, 28 in the thickness direction of the plug 1.

The contacts 20 include the two kinds consisting of: the first contacts 20*b*, 20*d*, 20*e* which have the first wire connecting portions 26, 27 in the upper portion of the rear side in the insertion direction of the plug 1 with respect to the receptacle, and which have a Y-like shape as viewed from the rear side in the insertion direction; and the second contacts 20*a*, 20*c* which have the second wire connecting portion 28 in the lower portion of the rear side in the insertion direction, and which have an inverted Y-like shape as viewed from the rear side in the insertion direction, and the first contacts 20*b*, 20*d*, 20*e* and the second contacts 20*a*, 20*c* are alternately arranged in the pitch direction. Therefore, the lead wires 71, 72, 73, 74 can be connected to the contacts 20 in a staggered manner. Consequently, the plug 1 can be configured as a small, thin, and narrow-pitch plug in which, while the pitch of the contacts 20 is narrowed, the diameter of the lead wires 71, 72, 73, 74 can be increased, and which has excellent electric characteristics.

The first wire connecting portions 26, 27 have: the one oblique sides 26*a*, 27*a* which extend toward the rear side in the insertion direction from the inclined portion 25*a* that is formed by obliquely bending the upper portion of the terminal portions 25 of the first contacts 20*b*, 20*d*, 20*e*; and the other oblique sides 26*c*, 27*c* which extend obliquely upward from the lower portions of the one oblique sides 26*a*, 27*a* via the bent portions 26*a*, 27*a*, and the second wire connecting portion 28 has: the one oblique side 28*a* which extends toward the rear side in the insertion direction from the inclined portion 25*b* that is formed by obliquely bending a lower portion of the terminal portion 25 of the second contact 20*a* or 20*c*; and the other oblique side 28*c* which extends obliquely downward from the upper portion of the one oblique side 28*a* via the bent portion 28*b*. Therefore, the contacts 20 in which the wire connecting portions have a V-like shape can be produced easily and economically by the same method as the conventional art.

The end contact 20*e* which is in one outermost side in the pitch direction, and the contact 20*d* which is inward adjacent the end contact are of the same kind, and the wire connecting portions 26, 27 of the end contact 20*e* and the inward adjacent contact 20*d* are short-circuited to each other. Therefore, the wire connecting portions 26, 27 of the end contact 20*e* and the inward adjacent contact 20*d* are short-circuited to each other by soldering without increasing the number of parts.

The number of the contacts 20 is larger by one than the number of the lead wires 71, 72, 73, 74, and the lead wire 74 is soldered to only the wire connecting portion 26 of the end contact 20*e*, in the short-circuited wire connecting portions 26, 27. Therefore, an extra contact which is not connected to one of the lead wires 71, 72, 73, 74 is not formed.

The body 40 has: the first soldering space 40*d* and second soldering space 40*e* which are formed in the upper and lower portions of the rear side in the insertion direction, respectively, and which house the ends of the lead wires 71, 72, 73, 74; the wall 40*f* which is formed between the first soldering space 40*d* and the second soldering space 40*e*; and the plural contact attachment grooves 43 which extend in the insertion direction from the end face of the wall 40*f*, and into which the whole lengths of the contacts 20 are insertable, the contact attachment grooves 43 include the two kinds consisting of: the first contact attachment grooves 43*b*, 43*d*, 43*e* which have the Y-shaped first contact insertion port 46 or 47, and into which the whole lengths of the first contacts 20*b*, 20*d*, 20*e* are inserted; and the second contact attachment grooves 43*a*, 43*c* which have the inverted Y-shaped second contact insertion port 48, and into which the whole lengths of the second contacts 20*a*, 20*c* are inserted, the first contact attachment grooves 43*b*, 43*d*, 43*e* and the second contact attachment grooves 43*a*, 43*c* are alternately arranged in the pitch direction, each of the first contact attachment grooves 43*b*, 43*d*, 43*e* has the configuration in which the upper portion of the first contact insertion port 46 or 47 is opened in the first soldering space 40*d* to form the V-shaped first groove 49 or 50 in the upper face of the wall 40*f*, the first groove supporting the first wire connecting portion 26 or 27 from the back side, and each of the second contact attachment grooves 43*a*, 43*c* has the configuration in which the lower portion of the second contact insertion port 48 is opened in the second soldering space 40*e* to form the inverted V-shaped second groove 51 in the lower face of the wall 40*f*, the second groove supporting the second wire connecting portion 28 from the back side. Therefore, not only the hold portion 21 of each contact 20 having the V-shaped wire connecting portion, but also the terminal portion 25 and the wire connecting portions 26, 27, 28 can be held by the body 40, and the holding force of the contact 20 having the V-shaped wire connecting portion can be enhanced. While the soldering spaces 40*d*, 40*e* for the lead wires 71, 72, 73, 74 are ensured necessarily and sufficiently without being affected by the V-like shape of the wire connecting portions, the wire connecting portions 26, 27, 28 in a state where they are positioned and fixed can be exposed with high positional accuracy in the soldering spaces 40*d*, 40*e* for the lead wires 71, 72, 73, 74. Therefore, the workability of soldering of the lead wires 71, 72, 73, 74 can be further improved and the solder accuracy can be enhanced.

The contact attachment groove 43*e* of the end contact 20*e* is formed as the first/second contact common attachment groove 43*e* which functions as both the first contact attachment groove and the second contact attachment groove, and the whole length of the end contact 20*e* is inserted into the first/second contact common attachment groove 43*e*, the first/second contact common attachment groove 43*e* having the first/second contact common insertion port 52 which functions as both the first contact insertion port 46 and the second contact insertion port 48, the first/second contact common attachment groove having the configuration in which the upper portion of the first/second contact common insertion port 52 is opened in the first soldering space 40*d* to form the first groove 49 in the upper face of the wall 40*f*, and the lower portion of the first/second contact common insertion port 52 is opened in the second soldering space 40*e* to form the second groove 51 in the lower face of the wall 40*f*. Therefore, it is possible to cope with the both cases where the end contact 20*e* is one of the first contacts, and where the end contact 20*e* is one of the second contacts. Consequently, the degree of freedom in design can be enhanced.

The body 40 has: the first bank 59 which is upward projected in the gap between the adjacent first wire connecting portions 26, 27 to be higher than the first wire connecting portions 26, 27; and the second banks 60 which are downward projected in the gap between the adjacent second wire connecting portions 28 to be lower than the second wire connecting portions 28. Therefore, it is possible to prevent a solder bridge from being formed between the adjacent first wire connecting portions 26, 27, and between the adjacent second wire connecting portions 28. Therefore, the gaps between the adjacent first wire connecting portions 26, 27, and between the adjacent second wire connecting portions 28 can be made minimum. Consequently, the pitch interval of the contacts 20 can be reduced without reducing the sizes of the wire connecting portions 26, 27, 28, and hence the plug 1 can be further miniaturized. Alternatively, the sizes of the wire connecting portions 26, 27, 28 can be made larger without increasing the pitch interval of the contacts 20. As a result, the workability of soldering of the lead wires 71, 72, 73, 74 can be further improved and the solder strength can be further enhanced.

The both side faces of the first bank 59 are formed as the inclined faces 59*a*, 59*b* which rise from the surface of the one oblique side 27*a* of the one adjacent first wire connecting portion 27 and that of the other oblique side 26*c* of the other first wire connecting portion 26, with a steeper inclination angle than the oblique sides 27*a*, 26*c*, and the both side faces of each of the second banks 60 are formed as the inclined faces 60*a*, 60*b* which rise from the surface of the one oblique side 28*e* of the one adjacent second wire connecting portion 28 and that of the other oblique side 28*c* of the other second wire connecting portion 28, with a steeper inclination angle than the oblique sides 28*a*, 28*c*. Therefore, molten solder hardly overrides the first and second banks 59, 60, and hence a high solder bridge preventing effect can be attained. In the case where the ends of the lead wires 71, 72, 73, 74 are placed on the first wire connecting portions 26, 27 and the second wire connecting portions 28, the first and second banks 59, 60 do not obstruct the placement work, and moreover the inclined faces 59*a*, 59*b* of the first bank 59 and the inclined faces 60*a*, 60*b* of the second banks 60 function as guides for introduction of the ends of the lead wires 71, 72, 73, 74 into the first wire connecting portions 26, 27 and the second wire connecting portions 28. Therefore, the workability of soldering of the lead wires 71, 72, 73, 74 can be further improved.

The plug 1 is a micro USB plug which is compliant with a micro USB connector standard, and which is smallest and thinnest among present USB connectors. Because of the V-like shape of the wire connecting portions of the contacts 20, the workability of soldering of the lead wires 71, 72, 73, 74 can be improved and the solder strength can be enhanced without impairing the size of the plug, and while preventing a phenomenon that molten solder drips from the wire connecting portions 26, 27, 28 to form a solder bridge between adjacent contacts, from occurring.

Therefore, the plug 1 can provide a connector in which, while miniaturization and thinning are attained at a level equivalent to the conventional art, it is possible to prevent a phenomenon that molten solder drips from the wire connecting portions 26, 27, 28 to form a solder bridge between adjacent contacts, from occurring, and the lead wires 71, 72, 73, 74 can be soldered to the wire connecting portions 26, 27, 28 with excellent workability and high strength.

In the attached state, the latches 30 are fixed and held in a state where the hold portions 31 are press inserted into the hold portion attachment portions 53 and locked by biting of the engagement claws 23 into the resin of the grip portion 40*a*, the spring portions 32 are housed in the spring portion attachment portions 54 in a vertically elastically displaceable manner, and the engaging portions 34 are projectingly placed in the upper faces of right and left sides which are laterally-outside the recess 40*g* of the fitting portion 40*b*.

The rotation restricting portion 35 of the left latch 30 is inserted into the latch insertion port 55 of the left latch attachment groove 44*a*, and the engaging piece 35*b* butts against and is engaged with the engaging face 57 of the body 40 from the lower side. The rotation restricting portion 36 of the right latch 30 is inserted into the latch insertion port 56 of the right latch attachment groove 44*a*, and the engaging piece 36*b* butts against and is engaged with the engaging face 58 of the body 40 from the lower side. According to the configuration, when the plug 1 is inserted into or extracted from the receptacle, it is possible to restrict rotation of the latches 30 in a counterclockwise direction in FIG. 10 caused by pressing down of the engaging portions 34, whereby reduction of the locking function of the plug 1 caused by reduction of the latch holding force of the body 40 due to shaving off of the resin in the peripheries of the hold portion attachment portions 53 can be prevented from occurring.

As shown in FIGS. 3, 13, 14A, 14B, 14C, and 14D, the shell 80 has: a rectangular base 81 which is formed by stamping a flat plate of a metal such as spring stainless steel that is slightly thicker than the contacts 20, and then bending the stamped metal plate, and which covers the grip portion 40*a* of the body 40; and plural side plates which are formed by raising extension portions of the base 81. The side plates include: a front side plate 82 formed by raising at a bending angle of about 45 deg. an extension portion of the base 81 which extends from the front edge, in such a manner that the side plate extends along the inclined face 40*c* in which the front end face of the grip portion 40*a* that is above the fitting portion 40*b*, and which constitutes the step face between the upper face of the grip portion 40*a* of the body 40 and that of the fitting portion 40*b* is obliquely rearward inclined by about 45 deg.; and right and left side plates 83, 84 formed by raising at a bending angle of about 90 deg. extension portions which extend from the right and left edges of the base 81, in such a manner that the side plates extend along the right and left side faces of the grip portion 40*a* of the body 40.

The shell 80 further has: a tubular portion 85 which is formed by bending, into a rectangular tube shape, an extension portion that further extends from the front side plate 82, and which is wider than the base 81 and the front side plate 82, so as to extend the peripheral side face of the fitting portion 40*b* of the body 40; and a cable press plate 87 which is rearward projected from a middle portion of the rear edge of the base 81 through a connecting piece 86.

The shell 80 further has: engagement claws 83*a*, 83*b*, 84*a*, 84*b* configured by spring pieces which are formed by outward cutting and raising two or front and rear places of each of the right and left side plates 83, 84; latch windows 85*a*, 85*b* which are opened in right and left side portions of an upper portion of the peripheral wall of the tubular portion 85; and grounding contact pieces 85*c*, 85*d* configured by thin spring pieces which are formed by downward cutting and raising two or right and left places of the lower portion of the peripheral wall of the tubular portion 85.

When the shell 80 is formed by bending a stamped flat metal plate, bent portions are rounded. In the side plates formed by bending the extension portions of the base 81, therefore, gaps 88, 89 are formed between the right and left edges of the front side plate 82, and the front edges of the right and left side plates 83, 84. Moreover, the gaps 88, 89 are not formed as slit-like thin gaps, but as large triangular gaps because the front side plate 82 is formed by raising an extension portion of the base 81 at a bending angle of 45 deg., and the right and left side plates 83, 84 are formed by raising extension portions of the base 81 at a bending angle of 90 deg.

In a state where the front side of the body 40 is opposed to the rear side of the shell 80, the fitting portion 40*b* of the body 40 is pressingly inserted into the tubular portion 85 of the shell 80 while the body 40 is pressed to the inside of the shell 80, whereby the shell 80 is attached to the outside of the body 40.

In the shell 80 in the attached state, the periphery of the fitting portion 40*b* of the body 40 is covered by the tubular portion 85 to cover the recess 40*g* of the fitting portion 40*b*, and the upper and right and left side faces of the grip portion 40*a* of the body 40 are covered by the base 81 and the right and left side plates 83, 84. The inclined face 40*c* in which the front end face of the grip portion 40*a* that is above the fitting portion 40*b*, and which constitutes the step face between the upper face of the grip portion 40*a* of the body 40 and that of the fitting portion 40*b* is obliquely rearward inclined by about 45 deg. is covered by the front side plate 82. The connecting piece 86 and cable press plate 87 of the shell 80 extend on the upper surface of the end portion of the cable 70 from a rear upper portion of the body 40. Therefore, the fitting portion 40*b* of the body 40 is opened only in the front side, the contacting portions 24 of the contacts 20 are projectingly juxtaposed at the constant pitch in the lateral direction in the fitting portion 40*b*, and the engaging portions 34 of the right and left latches 30 are projectingly placed in the right and left side portions of the upper metal surface of the fitting portion 40*b* through the right and left latch windows 85*a*, 85*b* of the tube portion 85.

Figure 4:
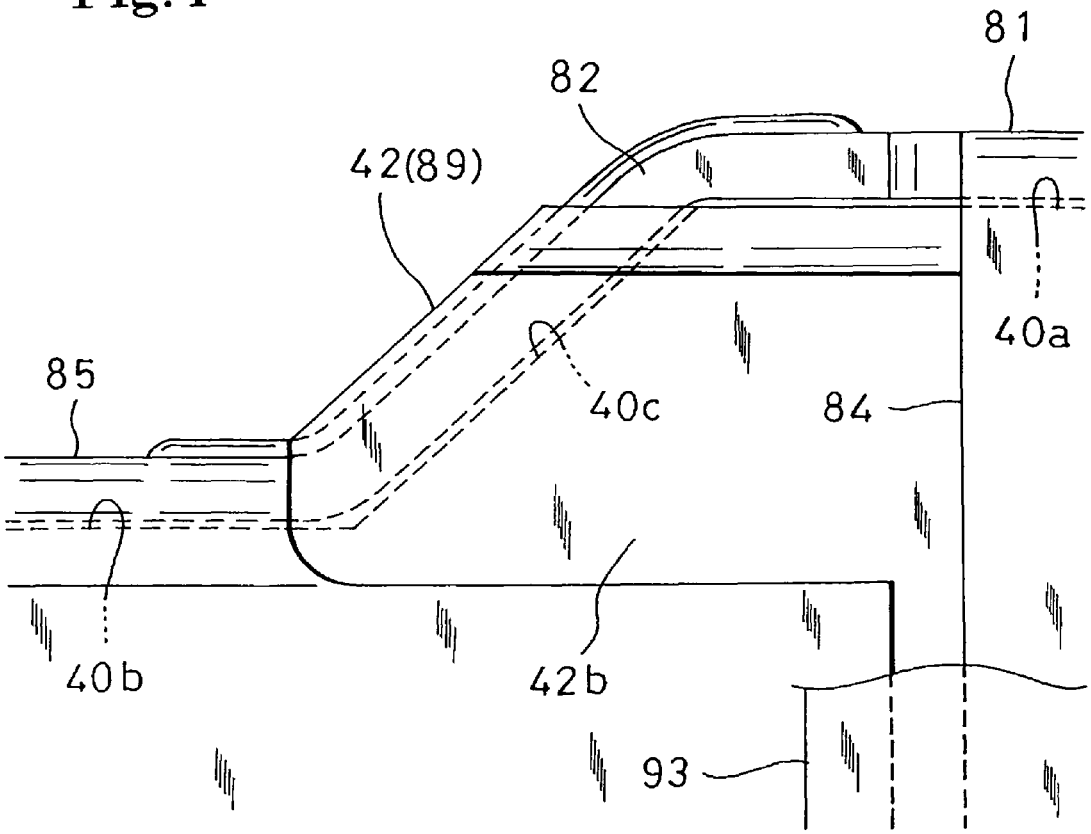
FIG. 4 is an enlarged right side view of the portion A in FIG. 3.

As shown in FIGS. 3, 4, and 5, the right and left sealing portions 41, 42 of the body 40 are forward projected from the right and left side portions of the inclined face 40*c*, and have a thickness and height which correspond to the lateral and vertical widths of the gaps 88, 89 of the shell 80, and a length which is slightly larger than the longitudinal width of the gaps 88, 89. The inner faces 41*a*, 42*a* of the right and left sealing portions 41, 42 which are opposed in the lateral direction are formed as a flat face, and the distance of the opposed inner faces 41*a*, 42*a* is set to be approximately equal to the lateral width of the front side plate 82 of the shell 80. The outer faces 41*b*, 42*b* of the right and left sealing portions 41, 42 are flush with the right and left side faces of the grip portion 40*a* of the body 40.

Immediately before completion of attachment of the shell 80 to the body 40, the thus configured right and left sealing portions 41, 42 are fitted into the right and left gaps 88, 89 of the shell 80 from their front end sides. As the fitting is further advanced, their opposed inner faces 41*a*, 42*a* are further fitted into the right and left gaps 88, 89 of the shell 80 while sliding contacting with the right and left end faces of the front side plate 82 of the shell 80. When attachment is completed, the right and left gaps 88, 89 of the shell 80 are completely closed. According to the configuration, during the over-mold process which is conducted in the final step of production of the plug 1, it is possible to prevent a molten resin from flowing into the inside through the right and left gaps 88, 89 of the shell 80. Therefore, it is possible to prevent a trouble such as that a molten resin flows through the right and left gaps 88, 89 of the shell 80 into the fitting portion 40*b* of the body 40 which is in the inner side, and the spring portions 22 and contacting portions 24 of the contacts 20, and the spring portions 32 and engaging portions 34 of the latches 30 become immovable, from occurring.

As shown in FIGS. 3, 15A, 15B, 15C, and 15D, then, the shell cover 90 is formed by stamping a flat plate of a metal such as spring stainless steel having a thickness which is slightly larger than the shell 80, and then bending the stamped metal plate, and has: a rectangular other base 91 which covers the lower face of the grip portion 40*a* of the body 40; and plural side plates which are formed by raising extension portions of the other base 91. The side plates include other right and left side plates 92, 93 formed by raising at a bending angle of about 90 deg. extension portions which extend from the right and left edges of the other base 91, in such a manner that the side plates extend along the outer faces of the right and left side plates 83, 84 of the shell 80.

The shell cover 90 further has: a U-like cable fixing plate 95 having legs which are upward opened on an end portion of a connecting piece 94 that is rearward projected from a middle portion of the rear edge of the other base 91; and engaging holes 92*a*, 92*b*, 93*a*, 93*b* which are opened in two or front and rear places of each of the other right and left side plates 92, 93.

In a state where the lower face the body 40 to which the shell 80 is attached is opposed to the inner face of the other base 91 of the shell cover 90, the right and left side plates 83, 84 of the shell 80 are overlaid on the inner sides of the other right and left side plates 92, 93 of the shell cover 90 while the body 40 is pressed to the inside of the shell cover 90, whereby the engagement claws 83*a*, 83*b*, 84*a*, 84*b* of the shell 80 are fitted into the engaging holes 92*a*, 92*b*, 93*a*, 93*b* of the shell cover 90, and the shell cover 90 is attached to the outside of the body 40 in a state where the shell cover is coupled and fixed to the shell 80.

In the attached state, the other base 91 which is opposed to the base 81 of the shell 80 covers the lower face of the grip portion 40*a* of the body 40, so that the shell cover 90 cooperates with the shell 80 to cover the whole periphery of the body 40, whereby a high shield effect is attained and the toughness of the plug body 10 is improved.

After the shell cover 90 is attached, in a state where an end portion of the cable 70 is placed on the inside of the cable fixing plate 95, the cable fixing plate 95 is crimped in a manner that the end portion of the cable 70 and cable press plate 87 of the shell 80 are embraced, whereby the end portion of the cable 70 is firmly coupled and fixed to the rear side of the plug body 10.

In the above-described configuration, the plug 1 is a plug comprising the plug body 10 which has the contacts 20 to be connected with the cable 70, in which the contacts 20 are held by the insulative body 40 and the body 40 is shielded by the shell 80 formed by a metal plate, and a part of which is over-molded. The shell 80 has the rectangular base 81, and the plural side plates 82, 83, 84 formed by raising extension portions of the base 81, and the body 40 has the sealing portions 41, 42 which are fitted into the gaps 88, 89 formed between the adjacent side plates 82 and 83, 84 of the shell 80, to close the gaps 88, 89.

The body 40 has: the grip portion 40*a* of the plug 1 which is formed in the rear side in the insertion direction of the plug 1 with respect to the receptacle; and the fitting portion 40*b* which is projected from the grip portion 40*a* toward the front side in the insertion direction, which is to be inserted into the receptacle, and which is thinner than the grip portion 40*a*. The shell 80 has: the front side plate 82 which covers the front end face 40*c* of the grip portion 40*a* that is in the front side in the insertion direction; the right and left side plates 83, 84 which extend along the right and left side faces adjacent to the front end face 40*c* of the grip portion 40*a*; and the tubular portion 85 which is formed by bending an extension portion of the front side plate 82, and which covers the fitting portion 40*b*. The sealing portions 41, 42 are fitted into the gaps 88, 89 formed between the front side plate 82 and the side plates 83, 84 to close the gaps 88, 89. The range from the grip portion 40*a* of the body 40 of the plug body 10 to the root portion of the fitting portion 40*b* is overmolded.

The body 40 further has the latches 30 which, when the fitting portion 40*b* of the body 40 is inserted into a receptacle, are engaged with the receptacle.

The shell 80 has the fixing portion 87 which is configured by an extension portion located in the rear side of the base 81 in the insertion direction, and which is to be coupled to the cable 70 connected to the contacts 20, and the range from an end portion of the cable 70 to the root portion of the fitting portion 40*b* via the grip portion 40*a* of the body 40 of the plug body 10 is over-molded.

The plug 1 further comprises the shell cover 90 which has: the other base 91 opposed to the base 81; and the other right and left side plates 92, 93 that are formed by raising extension portions of the other base 91, and that overlap the right and left side plates 83, 84, and which is configured by a metal plate cooperating with the shell 80 to cover the whole periphery of the grip portion 40*a* of the body 40.

The shell cover 90 has the other fixing portion 95 which is configured by an extension portion located in the rear side of the other base 91 in the insertion direction, and which is to be coupled to the cable 70 connected to the contacts 20.

Therefore, the plug 1 can provide a connector in which the gaps 88, 89 of the shell 80 that are inevitably formed are closed by the sealing portions 41, 42 of the body 40, and hence it is possible to, during the over-mold process, prevent a molten resin from flowing into the inside through the right and left gaps 88, 89 of the shell 80, thereby preventing a trouble such as that the movable portions, for example, the contacts 20 and the latches 30 become immovable, from occurring.

Although the preferred embodiment of the connector (plug) of the invention has been described with respect to the plug 1 which is a micro USB connector, the invention is not restricted to this, and various modifications may be made without departing the spirit and scope of the invention.

What is claimed is:

1. A connector, comprising:

a shell formed by a metal plate having a rectangular base, a front side plate with right and left end faces, and plural side plates formed by raising extension portions of said rectangular base;

an insulative body which has a grip portion which is formed in a rear side in an insertion direction of the connector with respect to a counter connector, and a fitting portion which projects from said grip portion toward a front side in the insertion direction, which is to be inserted into the counter connector , said grip portion having right and left side portions and a front end face, and said fitting portion having right and left side portions; and a plug body which has contacts to be connected to a cable, and in which said contacts are held by said insulative body, said insulative body is shielded by said shell, wherein:

a part of said plug body is over-molded;

said insulative body has sealing portions which are formed as fixed protrusions projecting from said front end face and from said right and left side portions, which are continuous and flush with said right and left side portions of said grip portion and said right and left side portions of said fitting portion, which have inner faces which cover said right and said left end faces of said front side plate of said shell, which are vertical with respect to said front end face, and which are fitted into gaps formed between said adjacent side plates of said shell to close said gaps, said fitting portion is thinner than said grip portion;

said shell further has: a front side plate which covers a front end face of said grip portion that is in the front side in the insertion direction: right and left side plates which extend along right and left side faces adjacent to said front end face of said grip portion; and a tubular portion which is formed by bending an extension portion of said front side plate, and which covers said fitting portion;

said sealing portions are fitted into gaps formed between said front side plate and said right and left side plates to close said gaps; and a range from said grip portion of said insulative body to a root portion of said fitting portion is over-molded.

2. The connector according to claim 1, wherein:

the connector has a latch which is engaged with the counter connector, when said fitting portion of said insulative body is inserted into the counter connector.

3. The connector according to claim 1, wherein:

said shell further has a fixing portion which is configured by an extension portion located in the rear side of said base in the insertion direction, and which is to be coupled to the cable connected to said contacts, and a range from an end portion of the cable to the root portion of said fitting portion via said grip portion of said insulative body is overmolded.

4. The connector according to claim 1, wherein:

said connector further comprises:

a shell cover which has: another base opposed to said base; and other right and left side plates that are formed by raising extension portions of said other base, and that overlap said right and left side plates, and which is configured by a metal plate cooperating with said shell to cover a whole periphery of said grip portion of said insulative body.

5. The connector according to claim 1, wherein:

the connector is a micro USB plug which is compliant with a micro USB connector standard.

6. The connector according to claim 4, wherein:

said shell cover has another fixing portion which is configured by an extension portion located in the rear side of said other base in the insertion direction, and which is to be coupled to the cable connected to said contacts.

* * * * *